US005794474A

United States Patent [19]

Willoughby et al.

[11] Patent Number: 5,794,474

[45] Date of Patent: Aug. 18, 1998

[54] METHOD AND APPARATUS FOR RESHAPING A CONTAINER BODY

[75] Inventors: Otis Willoughby, Boulder; Howard C. Chasteen, Golden; Greg Robinson, Louisville, all of Colo.

[73] Assignee: Ball Corporation, Muncie, Ind.

[21] Appl. No.: 779,859

[22] Filed: Jan. 3, 1997

[51] Int. Cl.[6] ..... B21D 26/02

[52] U.S. Cl. ..... 72/62

[58] Field of Search ..... 72/54, 56, 58, 72/60, 62, 61

[56] References Cited

U.S. PATENT DOCUMENTS

| | | | |
|---|---|---|---|
| 701,550 | 6/1902 | Deering . | |
| 1,448,457 | 3/1923 | Liddell . | |
| 1,951,381 | 3/1934 | Ward | 153/73 |
| 2,050,227 | 8/1936 | Mantle | 152/73 |
| 2,787,973 | 4/1957 | Heidmann | 113/44 |
| 3,252,312 | 5/1966 | Maier | 72/56 |
| 3,320,784 | 5/1967 | Heeren et al. | 72/56 |
| 3,376,723 | 4/1968 | Chelminski | 72/56 |
| 3,420,079 | 1/1969 | Erlandson | 72/56 |
| 3,526,020 | 9/1970 | Lemelson | 18/14 |
| 3,559,434 | 2/1971 | Keinanen | 72/56 |
| 3,593,551 | 7/1971 | Roth et al. | 72/56 |
| 3,613,423 | 10/1971 | Nakamura | 72/58 |
| 3,688,535 | 9/1972 | Keinanen et al. | 72/56 |
| 3,698,221 | 10/1972 | Couland | 72/62 |
| 3,698,337 | 10/1972 | Brawner et al. | 113/120 |
| 3,742,746 | 7/1973 | Erlandson | 72/56 |
| 3,797,294 | 3/1974 | Roth | 72/56 |
| 3,800,578 | 4/1974 | Brennan et al. | 72/56 |
| 3,810,372 | 5/1974 | Queyrolx | 72/56 |
| 3,857,265 | 12/1974 | Howeler et al. | 72/56 |
| 3,858,422 | 1/1975 | Tominaga et al. | 72/56 |
| 3,953,994 | 5/1976 | Brawner et al. | 72/58 |
| 3,974,675 | 8/1976 | Tominaga et al. | 72/56 |
| 4,265,102 | 5/1981 | Shimakata et al. | 72/58 |
| 4,282,734 | 8/1981 | Eddy | 72/54 |
| 4,354,371 | 10/1982 | Johnson | 72/53 |
| 4,392,292 | 7/1983 | Irons | 29/421 |
| 4,513,497 | 4/1985 | Finch | 29/727 |
| 4,557,128 | 12/1985 | Costabile | 72/62 |
| 4,788,843 | 12/1988 | Seaman et al. | 72/58 |
| 4,827,605 | 5/1989 | Krips et al. | 29/727 |
| 4,928,509 | 5/1990 | Nakamura | 72/61 |
| 4,947,667 | 8/1990 | Gunkel et al. | 72/56 |
| 5,022,135 | 6/1991 | Miller et al. | 29/42.11 |
| 5,115,654 | 5/1992 | Swars et al. | 72/62 |
| 5,275,033 | 1/1994 | Riviere | 72/62 |
| 5,339,666 | 8/1994 | Suzuki et al. | 72/56 |
| 5,524,466 | 6/1996 | Coe | 72/62 |

FOREIGN PATENT DOCUMENTS

| | | | |
|---|---|---|---|
| 2047455 | 9/1970 | Germany . | |
| 57-88919 | 6/1982 | Japan . | |
| 1 332 461 | 10/1973 | United Kingdom | 72/62 |

*Primary Examiner*—David Jones
*Attorney, Agent, or Firm*—Sheridan Ross P.C.

[57] ABSTRACT

A method and apparatus for reshaping a container body (e.g., a metal, drawn and ironed container body) utilizing multiple fluids is disclosed. One fluid applies a generally low fluid pressure to the surface to be reshaped, while the other fluid applies a generally high fluid impact pressure to the surface to reform the same by changing its shape. In one embodiment, the interior of a drawn and ironed container body is pressurized with an appropriate gas (e.g., air) and a nozzle is introduced into the interior of the container body to apply a concentrated force to the interior surface of the container body with a high velocity liquid stream (e.g., water).

26 Claims, 13 Drawing Sheets

METHOD AND APPARATUS FOR RESHAPING A CONTAINER BODY

FIELD OF THE INVENTION

The present invention generally relates to reshaping container bodies and, more particularly, to utilizing multiple fluids for container body reshaping operations.

BACKGROUND OF THE INVENTION

Numerous techniques have been employed for forming thin-walled work pieces, including in particular, longitudinal welding and drawing/redrawing/ironing techniques used in forming three-piece and two-piece cylindrical metal container bodies, respectively. Subsequent modifications to metal container bodies can be achieved via die necking, roll or spin necking, and other secondary processes.

Die necking generally entails forcing the sidewall of a container body and an external die against one another, typically by relative longitudinal advancement of the container body through a concentric outer die. In roll and spin necking the sidewall of a container body is contacted by an external roller, and in some instances an internal roller, that can be contoured and/or radially/axially advanced to neck the container body.

Three methods are currently being used commercially to neck drawn and ironed beverage cans. These are die necking, where a can is pushed into a fixed die and piloted by an internal pilot, spin necking, where a can which has been die necked a number of times is spin shaped with two rollers while the metal is controlled with a control ring and chuck arrangement, and spin flow necking, where a single roller spin forms the can wall in conjunction with tools to control the metal. The two spinning type commercial necking methods are generally used in conjunction with the die necking process to produce commercial beverage cans.

All of the above-noted commercial necking methods have some disadvantages. The use of die necking operations alone requires a large number of stages (for example, a die neck from 211 to 202 requires from 12 to 14 stages for current technology), with high capital requirements, high tooling costs, and undesirable spoilage. The two spin necking processes require large, complex and expensive machines which are difficult and expensive to operate. In addition the current technology uses several die neck stages before the spin necking machines. The can producing industry continues to search for a better method of producing necks on beverage cans.

With regard to further shaping operations, recently symmetric longitudinal flutes or ribs, and diamond, waffle and numerous other patterns have been imparted to cylindrical container bodies through the use of either an internal roller and an external compliant mat, or by an internal roller and a matching external rigid forming element. Expanding mandrels have also been utilized on three-piece metal container bodies to impart such patterns.

The noted techniques are limited as to the diametric extent and complexity of shaping that can be achieved. By way of example, die-necking cannot readily be employed for current aluminum drawn and ironed beverage containers (e.g., containers having a sidewall thickness of about 4–7 mil.) to achieve diametric changes of more than about 3% in any single operation and does not generally allow for container diameters to be increased then decreased (or vice-versa) or for discontinuous/angled designs to be shaped along the longitudinal extent of a container body. While spin forming techniques have been found to allow for relatively high degrees of expansion (e.g., in excess of 15% for current aluminum drawn and ironed beverage containers), relative rotation between a container body and the forming roller is necessary, thereby restricting the ability to achieve non-circular cross-sections along the longitudinal extent of a container body.

Other proposed techniques also have limitations. For example, electromagnetic and hydrostatic processes have been considered which entail the use of magnetic fields and pressurized vessels, respectively, to force a container body sidewall outward against an outer shaping die. Both processes require, however, a container body to be of sufficient ductility to withstand substantial attendant plastic deformation without failure. For current drawn and ironed aluminum beverage containers, such deformation limits are believed to be less than 3% (and generally less than 2%) before failure is realized due to the limited ductility of the aluminum alloys utilized. While annealing such container bodies may provide sufficient ductility to allow a greater degree of metal deformation, it would lower the strength of the container bodies and require additional undesirable thermal processing.

SUMMARY OF THE INVENTION

One aspect of the present invention generally relates to container body shaping/reshaping operations utilizing two fluids (e.g., gases and/or liquids) (e.g., reforming metal, drawn and ironed container bodies having a generally cylindrical sidewall, a bottom integrally formed with this sidewall, and an open end opposite this integral bottom). One of these fluids is for effectively exerting reshaping forces on the container body and the other is for effectively "controlling" the container body during the application of these reshaping forces to the container body (e.g., to effectively "control" or "hold" the metal of the drawn and ironed container body while being reshaped). As such, these fluids may be characterized as being "different." Additional criteria associated with one or more of these fluids may support the characterization that these two fluids are "different." For instance, these fluids may be of different phases (e.g., one a gas and the other a liquid), these fluids may be introduced at different pressures (e.g., one discharged by a "high" pressure for generating the reshaping forces and another at a "low" pressure for providing the "control" function), and/or these fluids may come from different sources. In one embodiment, one fluid is essentially static and the other fluid is a high velocity fluid.

In one embodiment of the above-noted multiple fluid aspect, the present invention relates to exposing a surface of the container body to a first fluid under pressure and preferably under a substantially constant pressure, or a pressure which increases during the forming operation in a controlled manner, and during this exposure directing a second fluid preferably at a high velocity, which is different from this first fluid in accordance with the foregoing, against at least a portion of the container body to reshape the container body by changing its configuration. An application of this aspect is to pressurize substantially the entire interior of a container body with a first fluid (e.g., a gas) to a substantially constant pressure, and during this pressurized state, direct the second fluid (e.g., a liquid) against at least a portion of an interior surface of the sidewall of the container body, preferably at a high velocity, to reshape the same. This may be affected by introducing at least one nozzle into the interior of the container body, and rotating and axially advancing this nozzle(s) relative to the container body.

Variations of the above-noted multiple fluid aspect of the present invention exist, including the selection of one or more parameters to enhance one or more aspects of the reshaping operation. For instance, the magnitude of the preferably substantially constant pressure of the first fluid (e.g., air) in one embodiment may be selected to create a radial hoop stress in the container wall of between about 10% and about 50% of the yield strength of the container body to provide the noted "controlling" or "holding" function. In one embodiment in accordance with these values, the magnitude of the preferably substantially constant pressure of the first fluid is within the range of about 20 psi to about 100 psi, in another embodiment is within the range of about 30 psi to about 60 psi, and in yet another embodiment is no greater than about 40 psi.

The second fluid (e.g., water) may be in the form of a high-velocity stream which is directed toward the container body at a velocity within a range of about 400 feet per second and 900 feet per second to impact the same at this velocity. This may be affected by directing fluid, which is under a pressure which is within the range of 1,000 psi and 5,000 psi and preferably at least 1,000 psi, through a high-velocity nozzle (nozzle pressures listed). These characteristics of the second fluid, including the pressures specified for the second fluid in the case of a high velocity fluid stream, may be used in combination with those pressures set forth above for the first fluid as well.

The container body may further be "pre-loaded" in the above-noted multiple fluid aspect of the present invention. An axially-directed load (e.g., compressive) may be applied to the container body during the exposure of the container body to the pressurized first fluid and during the application of the reshaping forces to the container body by the action of the second fluid on the surface of the container body. In one embodiment, the axially compressive load ranges from about 10 pounds to about 50 pounds of force.

Further variations of the above-noted multiple fluid aspect include utilizing a gas (e.g., air) for the first fluid (i.e., for the exposing/pressurizing step or function) and/or utilizing a liquid (e.g., water) for the second fluid (i.e., for the directing step or function). The directing step or function may also be further characterized as directing the second fluid through the first fluid to impinge upon the container body, or directing a stream of liquid through air which is used to pressurize the interior of the container body. The exposing/pressurizing step/function may also be further characterized as acting on substantially the entire interior surface of the container body undergoing reformation, and/or the directing step/function may be further characterized as having the second fluid only impinge on a small, discrete portion of the container body.

Additional structure/methodology may be utilized in the multiple fluid aspect of the present invention. In the case where the container body includes a sidewall, an integrally formed bottom, and an open end, the open end of the container body may be appropriately sealed. Moreover, the interior of this container body may be drained during the reforming operations so as to remove the second fluid from the container body after it has acted on the container body portion being reshaped.

DETAILED DESCRIPTION

Figure 1A:
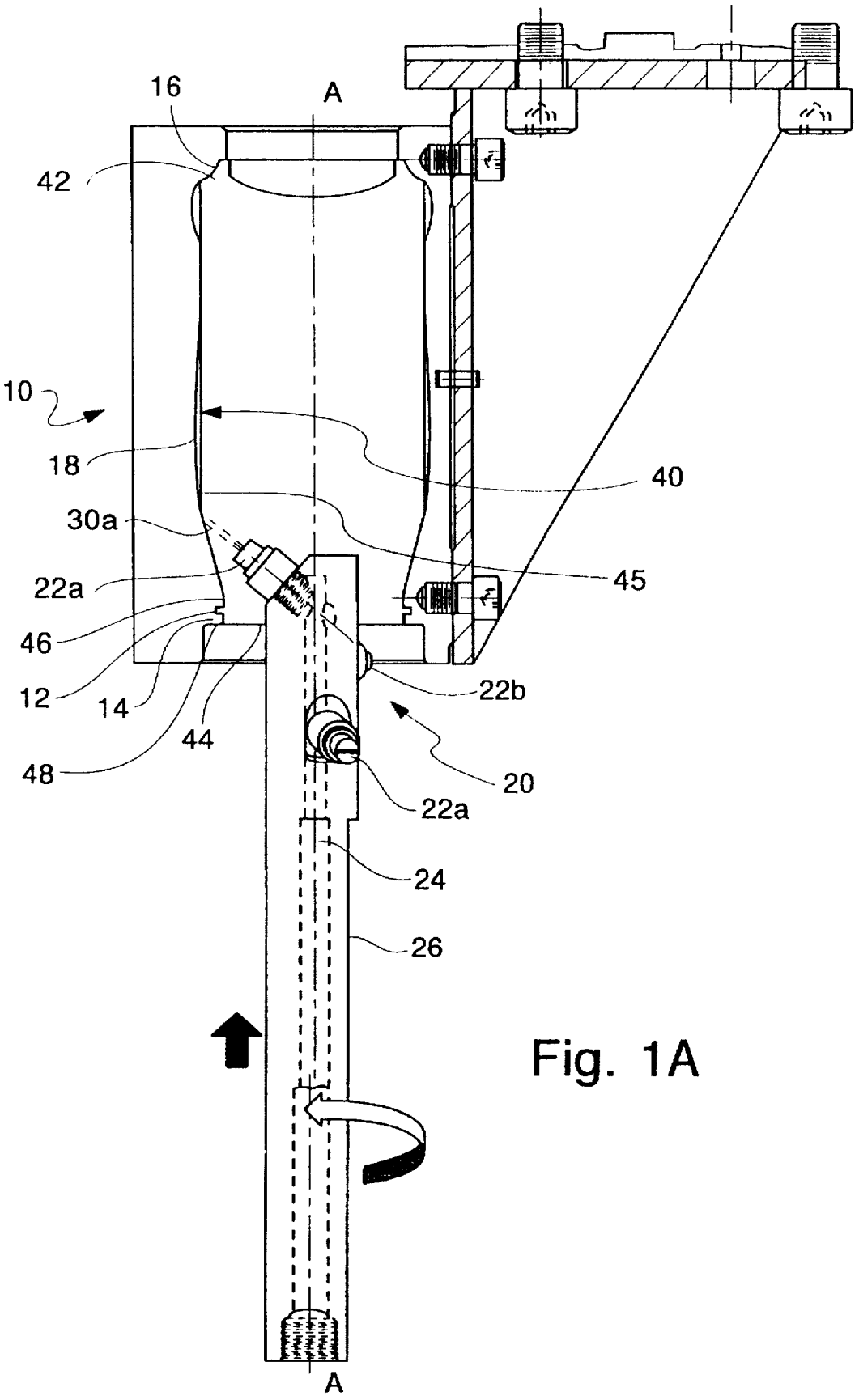
FIGS. 1A–1E are cross-sectional side views illustrating the operation of one embodiment of a container body reshaping apparatus.
Figure 1B:
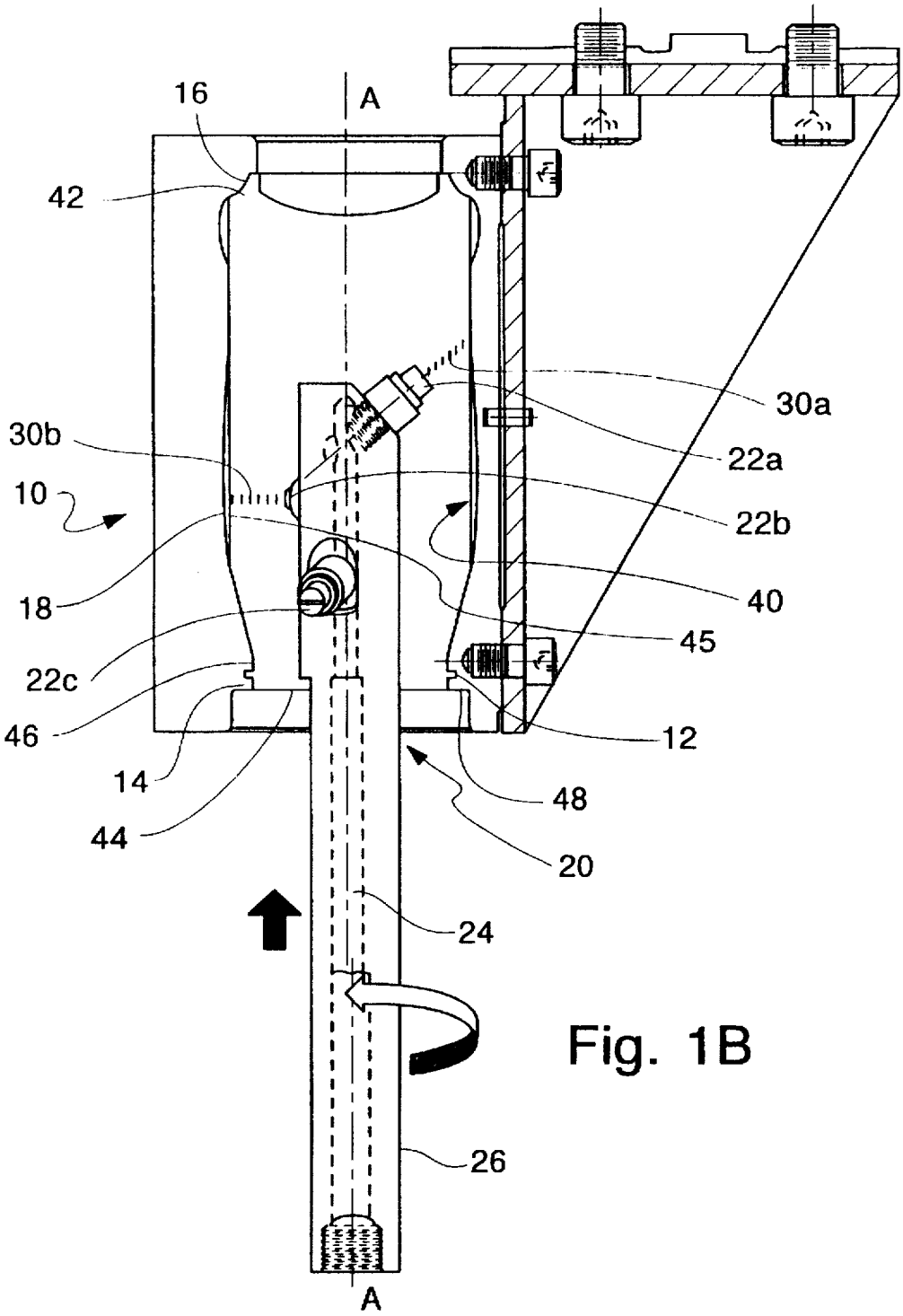

It is an object of one or more apparatus/methods to be discussed in more detail below to provide an apparatus/method for shaping and embossing thin-walled work pieces such as container bodies (e.g., having a sidewall thickness of no more than about 0.0070 inch), including in particular, the achievement of complex and non-uniform shapes/designs in the sidewalls of metal containers. It is a related objective of such apparatus/methods to provide for such shaping and embossing capabilities in a manner which does not require subsequent annealing of the container bodies, including in particular cylindrical drawn and ironed, aluminum and steel alloy containers.

At least one apparatus/method to be discussed in more detail below realizes the foregoing objectives by employing at least one pressurized fluid stream (e.g., liquid) that is ejected at high velocity directly against the sidewall of a container body to impart the desired shape/design. The word "pressurized" in relation to this fluid stream(s) is directed to the nozzle pressure of the fluid which converts the high pressure into a high velocity. The impact force generated by the fluid mass of the fluid stream(s) and its velocity is what is actually used to modify the shape of the container body.

The above-noted desired shape/design may be realized via relative predetermined movement between the container body and the fluid stream(s), the use of a configured surface positioned adjacent to the container body sidewall (i.e., wherein the fluid stream(s) work the sidewall towards the configured surface), predetermined variable control of the pressure which discharges the fluid stream(s) at the desired high velocity, and various combinations and subcombinations thereof.

It is important to note that the utilization of a directed fluid stream(s) allows for localized working of metal container body sidewalls to achieve high degrees of metal deformation (e.g., exceeding 15% for current drawn and ironed aluminum container bodies). In particular, by providing relative longitudinal and rotational movement of the fluid stream(s) and container body, localized working may progress in a helical fashion about and along a container body.

One or more aspects of one or more of the apparatus/methods to be discussed in more detail below allow for the achievement of complex and non-uniform shapes/designs, including geometric shapes/designs (e.g., diamonds, triangles, company logos, etc.), lettering (e.g., product/company names, etc. in block print, script, etc.) and fanciful shapes/designs having angled and/or arcuate shape-defining edges and/or surfaces that vary around, about and along the longitudinal extent of a container body. As should be appreciated, the realization of such shaping/embossing capabilities allows for marked product differentiation, aesthetically tailored designs for targeted purchasers, and other significant marketing-related opportunities in consumer product markets where such opportunities have heretofore been quite limited. By way of primary example, the ability to provide metal containers for soft drinks, beer, and other beverages with shapes/designs that match and even exceed that previously realized in glass bottles may well reshape the industry. Indeed, it is believed that one or more aspects of one or more of the apparatus/methods to be discussed in more detail below will enhance existing products and create entirely new product opportunities.

In one aspect of one or more apparatus/methods to be discussed in more detail below, a shape-defining means and spray means provide a configured surface and high velocity fluid stream(s), respectively, with at least one of the two being rotatable relative to the other to achieve progressive localized working (e.g., around a cylindrical container body sidewall). In this regard, it is preferable to dispose the spray means for rotation about the center axis of the container body. Specifically, the spray means may be advantageously provided on and directed outward for rotation about the container body center axis. Alternatively, the spray means can be on or offset from the center axis with the high velocity fluid stream(s) directed either outward and/or inward and the shape-defining means disposed for rotation thereabout together with the container body.

In a related aspect of one or more apparatus/methods to be discussed in more detail below, a shape-defining means and spray means provide a configured surface and high velocity fluid stream(s), respectively, with at least one of the two being longitudinally movable relative to the other to achieve progressive working (e.g., along the longitudinal extent of a cylindrical container body sidewall). In this regard, it is preferable to dispose the spray means to provide for longitudinal advancement and retraction on or parallel to the center axis of the container body. More particularly, the spray means may be advantageously directed outward from and disposed on the container body center axis for longitudinal advancement/retraction thereupon. Alternatively, the spray means can be on or offset from the center axis with the high velocity fluid stream(s) directed outward and/or inward and the shape-defining means disposed for longitudinal advancement/retraction parallel thereto together with the container body.

In another aspect of one or more apparatus/methods to be discussed in more detail below, a spray means is provided that includes at least one spray member (e.g., a fluid nozzle) spaced a predetermined distance from the container body sidewall to eject the high velocity fluid stream(s) directly thereagainst to achieve the desired shaping. Additionally, the spray means may advantageously include a plurality of spray members (e.g., fluid nozzles) to eject a corresponding plurality of high velocity fluid streams. Each spray member preferably acts to accelerate a fluid stream supplied via a common fluid channel to provide a corresponding high velocity fluid stream. It may be preferable to longitudinally space the spray members along and aim the spray members in differing directions relative to an axis coincidental or parallel to the container body center axis for enhanced container working and/or efficiencies. For example, where n spray members are utilized on a container body center axis, it may be preferable to aim a spray member outward each 360/n° degrees, as viewed along the center axis (e.g., if n=4, aim nozzles outward at 0°, 90°, 180° and 270°). Further, as viewed from a side of a given axis, it may be preferable for one or more of the spray members to be directed primarily outward (e.g., between about +30° to −30° relative to an axis normal to the container body center axis, and more preferably between about +15° to −15° relative to such normal axis), angled toward one end of the container body (e.g., between about +15° to +75°, relative to an axis normal to the container body center axis, and more preferably between about +30° to +60° relative to such normal axis) and/or angled toward the other end of the container body (e.g., between about −15° to −75° relative to an axis normal to the container body center axis, and more preferably between about −30° to −60° relative to such normal axis). The spray member(s) may be disposed at an angle other than perpendicular to the rotational axis of a rotating wand when viewed in a reference plane which is perpendicular to this rotational axis (e.g., by having the spray member(s) mounted on a rotatable wand such that when looking down the rotational axis of the wand, the spray member(s) will be disposed on the wand to provide an angle of ±20° between a reference ray, extending perpendicularly outwardly from the rotational axis of the wand, and a reference line, corresponding with the direction of the high velocity fluid stream ejected from the spray member(s) when the wand is not rotating). This type of positioning may be used to counteract the tendency of the high velocity fluid stream(s) to impact the container body wall at an angle other than perpendicular due to the high rotational speed of the wand, and may be provided by having the spray member(s) "point" in the direction of rotation of the wand. Such varying orientations can be utilized to provide high velocity fluid streams having non-parallel center axes, thereby yielding differing force, or shaping/embossing working vectors, for enhanced container working (e.g., by providing a shaping force vector near normal to any given region of a configured surface utilized for shaping/embossing).

Further, it may be advantageous to angle a spray member toward one end of a container body (e.g., between about +30° to +60° relative to an axis normal to the container body center axis) in order for the corresponding high velocity fluid stream(s) to reach a portion of a container body that may not otherwise be accessible (e.g., the bottom end of a domed, drawn and ironed, aluminum container body inverted for shaping operations). Further, it may be advantageous to have a spray member angled toward the other end of the container body (e.g., between about −30° to −60° relative to an axis normal to the container body center axis) to facilitate removal of the fluid utilized for shaping (e.g., when an open end of a container body is oriented downward for gravity fluid flow).

For current drawn and ironed, aluminum and steel container applications it is believed preferable to provide a high velocity fluid stream generated by a spray nozzle at a pressure of between about 1,000 psi and 10,000 psi and even more preferably between about 2,000 psi and 5,000 psi. Additionally, in such applications, in one embodiment the spray means is spaced at least about ¼", and most preferably between about ¼" to ½", from the container body sidewall. In another embodiment, the spray means is spaced from about ⅛" to about ¾" inch, and more preferably from about ¼" to about ½", from the container body surface being reformed. Relatedly, in one embodiment the width of the high velocity fluid stream is maintained at about 40 thousandths inch to about 60 thousandths inch. In another embodiment, the width of the high velocity fluid stream is maintained from about 0.040 inches to about 0.150 inches. Straight or fan spray patterns may be used for the fluid stream(s).

In yet another aspect of one or more apparatus/methods to be discussed in more detail below, the shape-defining means comprises a die assembly having a plurality of separable die members, and preferably two or more die members (e.g., three) to facilitate positioning and removal of a container body from a shaping/embossing location without damage to any decorative or internal coatings previously applied thereto. In this regard, it is also preferable to dispose each die member for radial advancement and retraction relative to the center axis of the container body. Further, it is preferable for the configured surface collectively defined by the die members of the die assembly to comprise selected portions for capturing, engaging and positioning corresponding portions of the container body to be shaped/embossed (e.g., the necked and/or flanged top portion and reduced bottom end portion of a drawn and ironed metal container body).

Preferably, the die assembly is disposed outside and around the container body to be shaped/embossed, with a spray means disposed inside of the container body. Further, and as will be appreciated, the shape-defining means should maintain a constant position relative to a container body once positioned for shaping/embossing operations. As noted, while it is generally preferred to provide for the rotation and/or longitudinal advancement/retraction of the spray means relative to the shape-defining means (e.g., to reduce the amount of physical mass and weight to be moved), there may be applications where rotation and/or longitudinal advancement/retraction of the shape-defining means relative to the spray means, or rotation and/or longitudinal advancement/retraction of both the shape-defining means and spray means proves desirable.

Additionally, while it generally believed preferable to dispose the shape-defining means outside of the container body for shaping/embossing operations, there are applications where it is preferable to position one or more die members adjacent to the inside surface of a container body with a spray means opposingly positioned on the outside of the container body. For example, such an arrangement may be particularly attractive where a company or product name or logo is to be inwardly embossed.

In use, one or more apparatus/methods to be discussed in more detail below broadly encompasses a container-forming process that includes the steps of forming a metal container body, optionally applying at least one or both of either internal coating or decorative coating to the formed container body, and subsequently by shaping/embossing the container body in accordance with one or more of the above-described aspects. As will be appreciated, the forming step may comprise conventional techniques for forming cylindrical, two-piece drawn and ironed aluminum alloy beverage container bodies, as well as weld-based techniques for forming cylindrical, three-piece steel container bodies. Further, such forming step may include various necking, flanging, doming and other known forming techniques currently employed in the container art. Similarly, the step(s) of applying an internal and/or external coating(s) may include conventional spraying techniques and other known approaches utilized in the art.

With particular respect to certain shaping/embossing methodology to be discussed in more detail below, key aspects include creating a high velocity fluid stream(s), directing the fluid stream(s) directly against one side of a thin wall of a container body, and moving at least one of the container body or fluid stream(s) and/or disposing a configured surface on the other side of the thin-wall work piece in opposing relation to a high velocity fluid stream(s) wherein the work piece is shaped/embossed between the fluid stream (s) and configured surface. Additional specific shaping/embossing steps include rotating and/or longitudinally advancing and/or retracting at least one of the high velocity fluid stream(s) and container body relative to the other for shaping/embossing. In this regard, it is again noted that such relative rotation and longitudinal movement will combinatively and desirably yield progressive and incremental working of a container body in a helical fashion. It should be further appreciated that such working may be bi-directional or uni-directional and may include a predetermined number of successive longitudinal advancement and/or retraction steps. Finally, it is also noted that by selectively controlling in a predetermined variable manner, the nozzle pressure for discharging the fluid stream(s) in relation to the relative positioning of the fluid stream(s) and container body (i.e., longitudinally and laterally (e.g., by rotation), complex shaping may be achieved apart from the use of a configured surface. Other variations, adaptations and advantages of the foregoing will be appreciated by those skilled in the art.

Additional apparatus/methods to be discussed in more detail below generally relate to necking container bodies or reducing the diameter of an open end of a typically thin-walled container body (e.g. having a sidewall thickness no greater than about 0.0070 inches). This necking may hereafter may be described herein in relation to a drawn and ironed container body which has a generally cylindrical sidewall disposed about a central, longitudinal axis of the container body ("container body central axis"), and which has a bottom which is integrally formed with this sidewall. Principles to be discussed below relating to necking are particularly desirable for these types of container bodies since the reduction in the diameter of the open end of the drawn and ironed container body allows for a reduction in the diameter of the separate end piece which is attached to this open end to seal the contents within the container. Reducing the diameter of the end piece required to seal the container body significantly reduces the material costs based upon the number of container bodies which are annually produced worldwide.

One aspect relating to one or more of the necking apparatus/methods to be discussed in more detail below relates to directing a fluid (e.g., a liquid such as water or other fluid types) against at least a portion of the exterior surface of the upper portion of the sidewall of the container body (e.g., to impart a radially inwardly directed force onto the exterior surface of the container body in relation to the container body central axis). This may be used to reduce the diameter of the open end of the container body. The fluid may be in the form of at least one and possibly two or more separate fluid streams which are each directed toward different portions of the exterior surface of the container body to impact a separate, discrete portion thereof. One or more radially spaced spray nozzles may be utilized to direct these fluid streams against the exterior surface of the container body and these fluid streams may be ejected from their respective nozzles at a high velocity.

Reducing the diameter of the open end of the container body in the above-noted manner may be used to form a neck on the upper portion of the sidewall. This neck generally tapers inwardly toward the container body central axis at a generally constant angle to define a generally frustumly-shaped structure. A flange or at least material for a flange may extend beyond the neck of the container body in a different orientation than the neck and thereby actually defines the open end of the container body. Flanges are utilized to seam the above-noted end piece onto the open end of the drawn and ironed container body to seal the contents of the container.

Various relative movements may be utilized to affect necking operations to reduce the diameter of the open end of the container body. Relative rotational movement between the container body and the directed fluid (e.g., each fluid stream) may be utilized for the fluid to provide its neck forming action on the container body (e.g., relative rotation between the fluid stream(s) and the container body about the container body central axis or an axis parallel thereto to allow the fluid stream(s) to work annular portions of the sidewall in a radially inward direction or toward the container body central axis). Relative longitudinal or axial movement between the container body and the directed fluid (e.g., each fluid stream) may also be utilized for the fluid to provide its neck forming action on the container body as well (e.g., relative axial movement between the fluid stream (s) and the container body along an axis parallel with the container body central axis to allow the fluid stream(s) to work longitudinal portions of the sidewall in a radially inward direction or toward the container body central axis). Typically both relative rotational and axial movement between the container body and the directed fluid will be utilized. These types of relative movements between the fluid stream(s) and the container body allow the above-noted fluid stream(s) to progressively work the sidewall further radially inwardly in the direction of the open end of the container body to form a generally frustumly-shaped neck on the upper portion of the container body.

Necking operations to reduce the diameter of the open end may be initiated at a location which is displaced a certain distance below the open end. Fluid on the exterior surface of the sidewall of the container body may initially impact the exterior surface of the container body at a location which is axially spaced from the open end of the container body. Relative axial movement between the fluid and the container body will progressively move this "region of contact" between the fluid and the container body to relatively advance this "region of contact" toward the open end of the container body. In the case where one or more spray nozzles are utilized, the spray nozzle(s) may be moved axially relative to the container body along an axis which is substantially parallel with the. container body central axis to progressively "move" the location where the stream(s) of fluid actually impacts the container body in the direction of the open end of the container body.

In cases where the container body is metal (e.g., drawn and ironed), the metal of the container body will have to be controlled in some type of manner during the noted necking operations in a commercial application. This may be affected by supporting at least certain portions of the interior surface of the container body during the reduction of the diameter. of the open end of the container body by the application of a fluid (e.g., one or more high velocity fluid streams) to the exterior surface thereof. For instance, a mandrel of some sort disposed within the interior of the container body may provide at least some degree of "control" by mechanically engaging portions of the container body. Fluid pressure may also provide a degree of control, with or without the mechanical support. Certain relative movements between the mandrel and the container body and/or the directed fluid may also have to be utilized.

Now various apparatus/methods will be described in relation to the accompanying drawings which assist in illustrating the various features of the present invention. The embodiment illustrated in FIGS. 1A–1E is for use in shaping/embossing aluminum and steel, drawn and ironed, cylindrical container bodies. Such embodiment includes a die assembly 10 and spray assembly 20 disposed for reciprocal longitudinal advancement/retraction along and rotation about center axis AA of container body 40.

Spray assembly 20 includes three longitudinally-spaced nozzles **22*a*, 22*b*, 22*c* for receiving a liquid (e.g., water) stream through channel 24 (shown in dashed lines) of a wand member 26 and for accelerating the water stream to eject corresponding, high velocity liquid streams 30*a*, 30*b*, 30*c*. As illustrated, the three nozzles 22*a*, 22*b*, 22*c* are aimed outward from the center axis AA at differing angles (i.e., every 120° from axis AA), and are disposed at varying angles relative to center axis AA. In particular, nozzle 22*a* is oriented upward at about 45°, nozzle 22*b* is oriented directly outward, and nozzle 22*c* is directed downward at about 45°, so as to provide differing localized coverages and shaping force vectors, facilitate access to the annular bottom end portion 42 of container body 40, and enhance removal of liquid from the open top end 44 of container body 40. In addition, each of the spray nozzles 22*a*, 22*b*, 22*c* may be angled on the rotatable wand member 26 in a horizontal reference plane which is perpendicular to the center axis AA of the wand member 26, and this is illustrated in FIG. 1E. The view presented in FIG. 1E is looking down the center axis AA of the rotatable wand member 26 (the rotational axis of the wand member 26) to illustrate this type of positioning for the spray nozzle 22*c*. As can be seen in FIG. 1E, the spray nozzle 22*c* is mounted on the rotatable wand member 26 such that there is an angle $\lambda$ between a reference ray RR1 extending perpendicularly outwardly from the axis AA and reference line RL1 which corresponds with a vector of the high velocity fluid stream ejected from the spray nozzle 22*c* when the wand member 26 is not rotating. In one embodiment, this angle $\lambda$ is $\pm 20°$. This type of positioning for the spray nozzles 22*a*, 22*b*, and 22*c* may be used to counteract the tendency of the high velocity fluid streams ejected therefrom to impact the sidewall of a container body 40 at an angle other than perpendicular due to the high rotational speed of the wand member 26. This may be provided by "pointing" the spray nozzles 22*a*, 22*b*, and 22*c* in the direction of rotation of the wand member 26** as illustrated in FIG. 1E.

In operation, a container body 40 is positioned in a cavity defined by at least two, and preferably three or more separable die members comprising die assembly 10 and collectively defining a configured surface 18. Engaging means 12 (e.g., resilient members inserted into corresponding grooves of the die members) is provided in die assembly 10 to supportably engage and position portion 46 of container body 40. Further, a ledge 14 and reduced portion 16 are collectively defined by the die members of die assembly 10 to interface with flanged end 48 and bottom end 42 of container body 40, respectively, for positioning and retention purposes.

In the illustrated embodiment, the configured surface 18 defines the desired shape to be imparted to the sidewalls 45 of cylindrical container body 40. In this regard, the desired shaping may include surfaces and edges that are angulated and otherwise non-uniform around and along the cylindrical container body 40.

Shaping is initiated in the illustrated embodiment by the supply of liquid through channel 24 of wand member 26, and the longitudinal advancement and rotation of wand member 26 within the container body 40. It is believed that the high velocity fluid streams 30*a*, 30*b*, 30*c* should be ejected from nozzles 22*a*, 22*b*, 22*c* utilizing a nozzle pressure of between about 1,000 psi and 10,000 psi, and more preferably between about 2,000 psi and 5,000 psi, to achieve effective working without degradation to internal coatings and/or external decoration applied to container body 40. In the illustrated embodiment, each stream 30*a*, 30*b*, 30*c* is of generally a cylindrical or fan configuration. It is currently believed preferable for the diameter of the streams 30*a*, 30*b*, 30*c* in one embodiment to be about 40 thousandths to 120 thousands inch, and in another embodiment to be about 40 thousandths to about 60 thousandths inch.

Figure 1C:
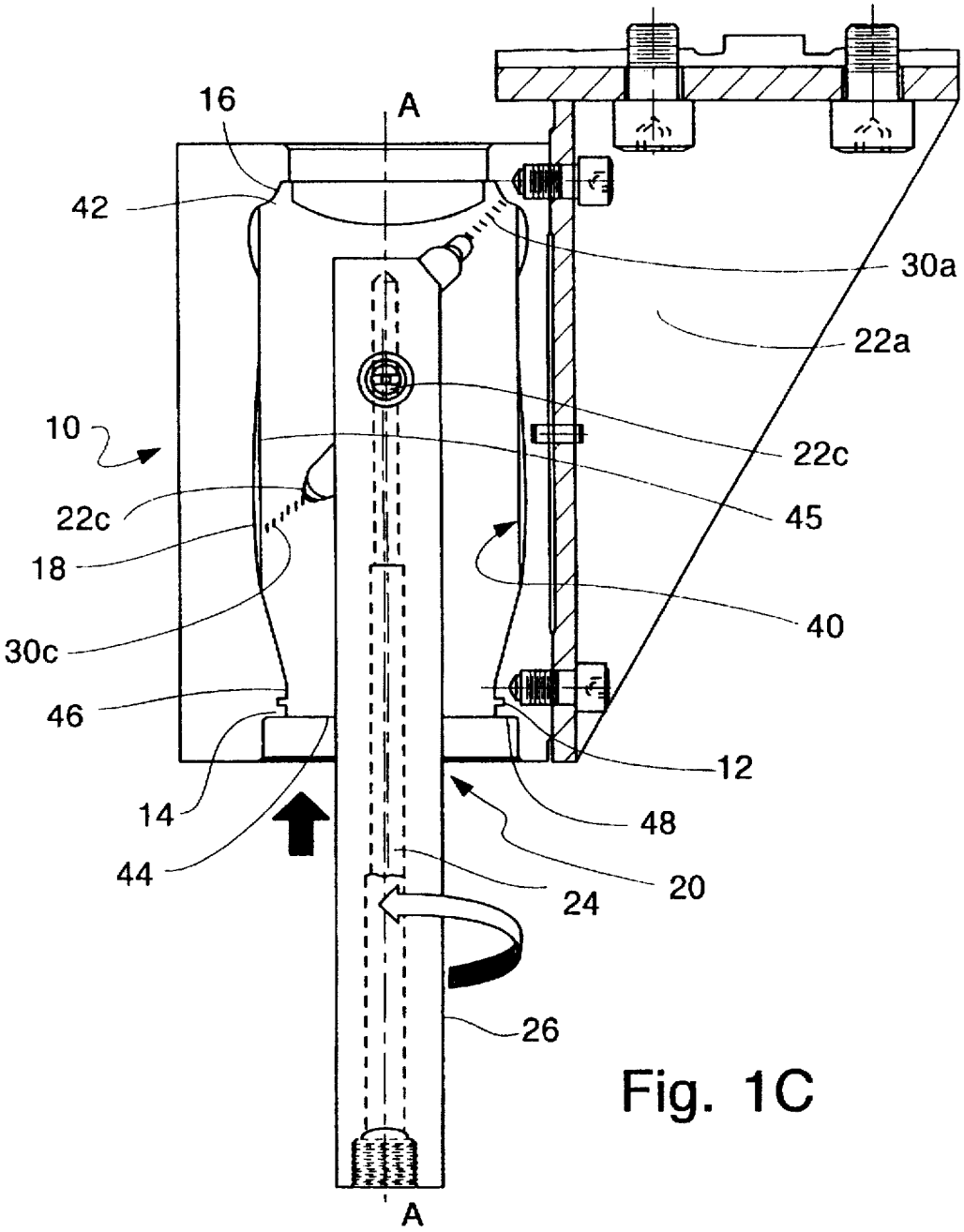
Figure 1D:
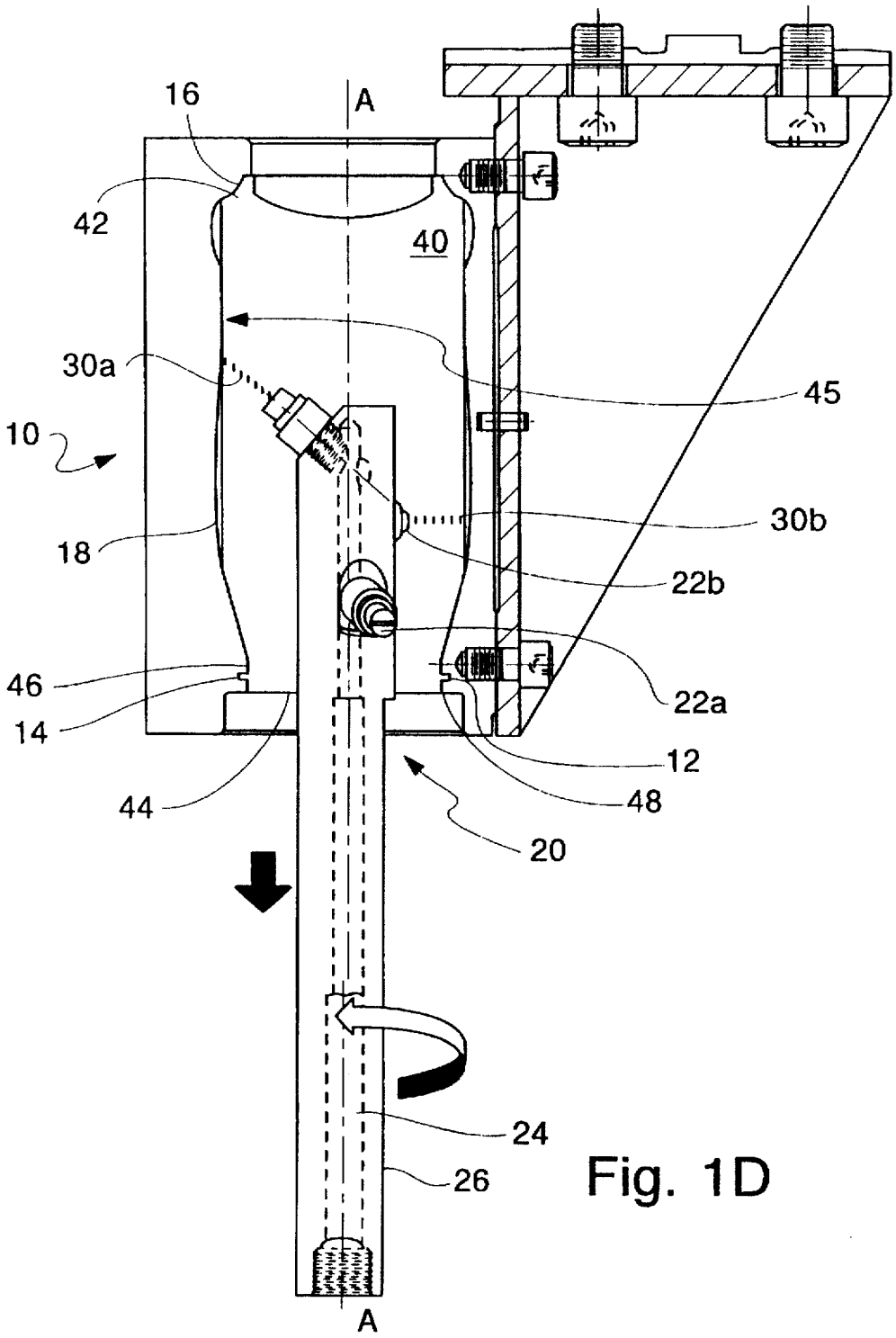
Figure 1E:
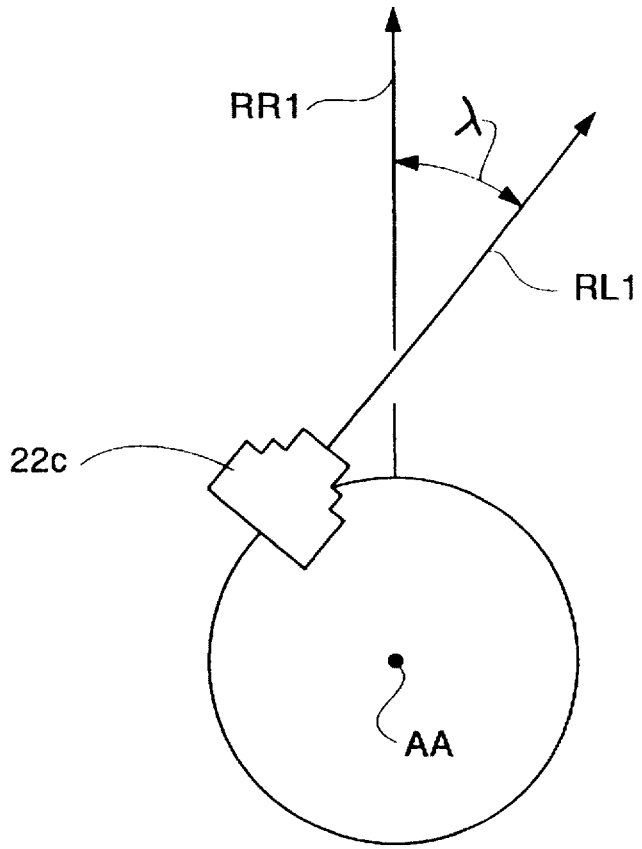

In FIG. 1A, wand member 26 has been longitudinally advanced such that nozzle 22*a* has initiated progressive helical working of container sidewall 45. As the wand member 26 rotates and continues its longitudinal ingress per FIG. 1B (reshaping operations can be performed during ingress and/or egress), high velocity fluid streams 30*b* and 30*c* ejected from nozzles 22*b* and 22*c* also progressively shape the container body sidewall in a helical fashion. As shown in FIG. 1C, as the wand member 26 reaches the end of its longitudinal travel nozzle 22*a* is able to achieve shaping in the bottom 42 of the container body 40 due to its upward angulation. FIG. 1D illustrates the continued working of the container body sidewall 45 during retraction of wand member 26. Throughout the shaping/embossing operation, it should be noted that the downward orientation of nozzle 22*c* will assist in removing the liquid utilized to form the high velocity fluid streams 30*a*, 30*b*, 30*c* from container body 40. The longitudinal advancement and retraction of spray assembly 20 within container body 40 may be repeated for a predetermined number of iterations to complete the desired shaping/embossing. Further, the supply of liquid to spray assembly 20 may be controlled to provide for shaping/embossing only upon advancement or retraction of spray assembly 20 and/or any predetermined combination of advancements/retractions. Similarly, the rate and degree of shaping can be controlled by selectively controlling the rate of longitudinal travel and rotation of wand member 26, as well as by selectively controlling the flow rate of liquid supplied to the nozzles 22*a*, 22*b*, 22*c* (i.e., thereby selectively controlling the velocity of fluid streams 30*a*, 30*b*, 3c).

A laboratory bench-rig implementation will now be described with reference to FIG. 2. It should be appreciated, however, that the above-described principles are in no way limited to such laboratory bench-rig implementation. In this regard, for example, a production implementation of the above-described principles could include further automation of one or more of the operative components demonstrated by the laboratory bench-rig implementation to facilitate continuous processing.

Figure 2:
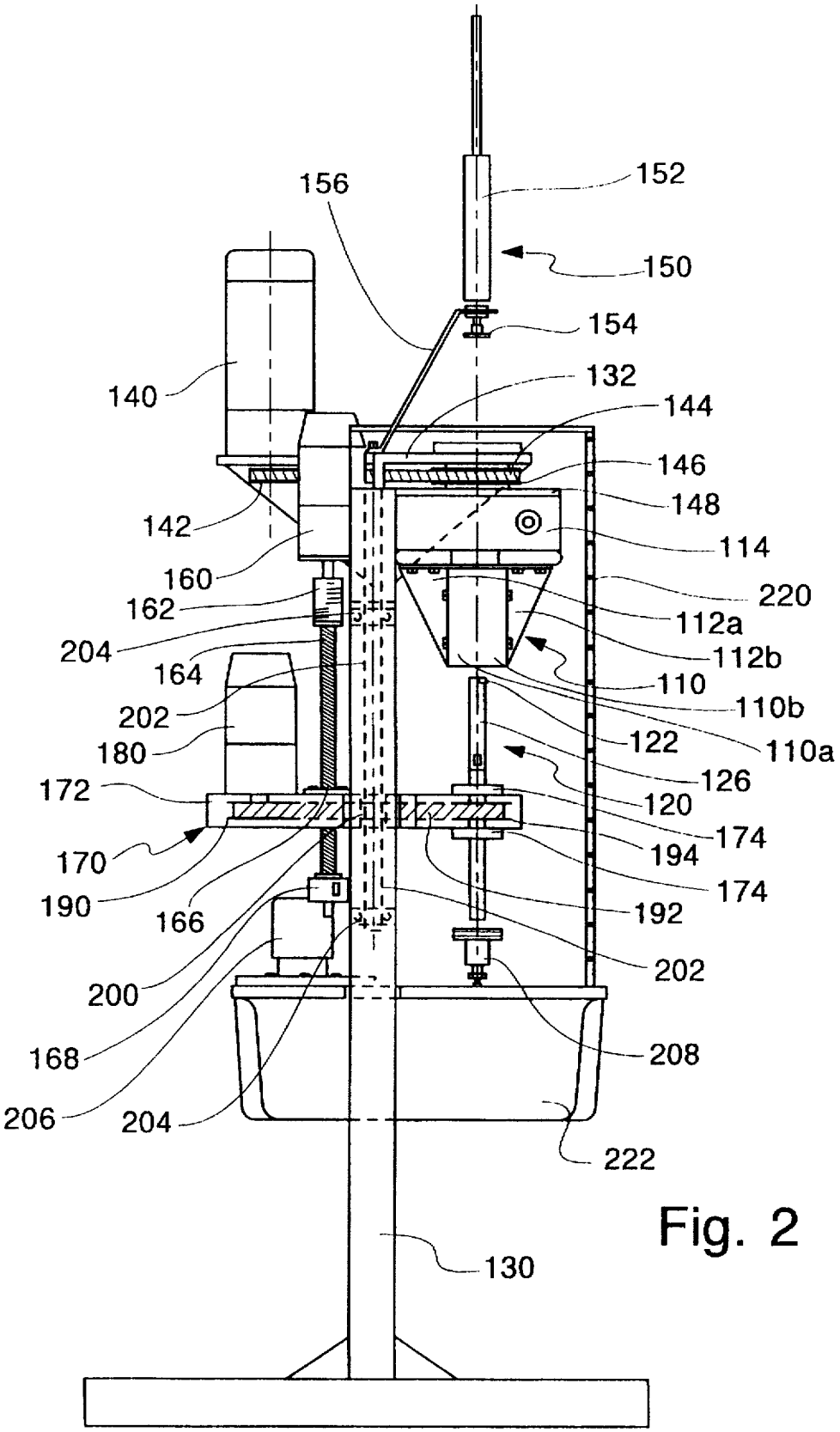
FIG. 2 is a side view illustrating a laboratory bench-rig of one embodiment of a container body reshaping apparatus.

In the laboratory bench-rig illustrated in FIG. 2, a die assembly 110 and spray assembly 120 are supportably interconnected to a common support frame 130. Die assembly 110 includes three die members two of which are shown as 110*a*, 110*b*, supportably interconnected via corresponding die supports (two shown) 112*a*, 112*b* to chuck 114. Chuck 114 internally includes a conventional worm gear arrangement (not shown) and thereby allowing the die assembly 110 to be opened and closed (e.g., for loading a container body therewithin) and rotatably driven (e.g., during shaping/embossing operations) by chuck motor 140 via pulleys 142, 146 and belt 147 therebetween. Further in this regard, chuck 114 engages chuck hub 148 and is supported by support member 132 connected to frame 130.

A container body loading assembly 150, comprising a piston/cylinder member 152 with suction cup 154, support 156 and interconnected vacuum generator (not shown) is provided to supportably interface with the bottom (e.g., a domed bottom end) of a container body and to vertically advance/retract the of container body into/from die assembly 110 for shaping/embossing operations.

Longitudinal travel of spray assembly 120 is provided by servo motor 160 mounted to frame 130 and interconnected to spray assembly 120 via coupling (i.e., servo screw) 162 to drive screw 164, which in turn supportably engages a carrier assembly 170 via threaded bushing 166. A servo screw pillow block 168 is provided at the bottom end of drive screw 164.

The carrier assembly 170 includes a main support 172 that extends through frame 130. Main support 172 carries a motor 180 at one end and is journaled via bearings 174 to a wand member 126 of spray assembly 120 at its other end. Motor 180 drives a pulley 190 positioned within support 172. In turn, pulley 190 is interconnected via drive belt 192 to pulley 194 that is positioned within support 172 and connected to wand member 126 so as to provide driven rotary motion to spray assembly 120 upon operation of motor 180. For alignment and stability, bushings 200 (one shown), interconnected to support 172, interface with linear shafts 202 (one shown) mounted to frame member 130 via linear shaft retainers 204. In operation, servo motor 160 turns drive screw 164 to advance or retract spray assembly 120 as desired. Further, motor 180 operates to drive pulleys 190 and 194, via drive belt 192, thus effecting rotation of the spray assembly 120 in a predetermined and variable manner as desired.

Liquid is supplied to the wand member 126 of spray assembly 120 via a high pressure pump (not shown) interconnected to wand member 126 via rotary union 208. The high pressure pump can be variably controlled in a predetermined manner to coordinate the velocity of the fluid stream eject by nozzle 122 with the relative positioning of nozzle 122 and die assembly 110 as desired for shaping/embossing. Shielding 220 and water capture 222/pressure pump 206 are provided in the prototype implementation to deflect and remove, respectively, water utilized in the shaping/embossing process.

Figure 3:
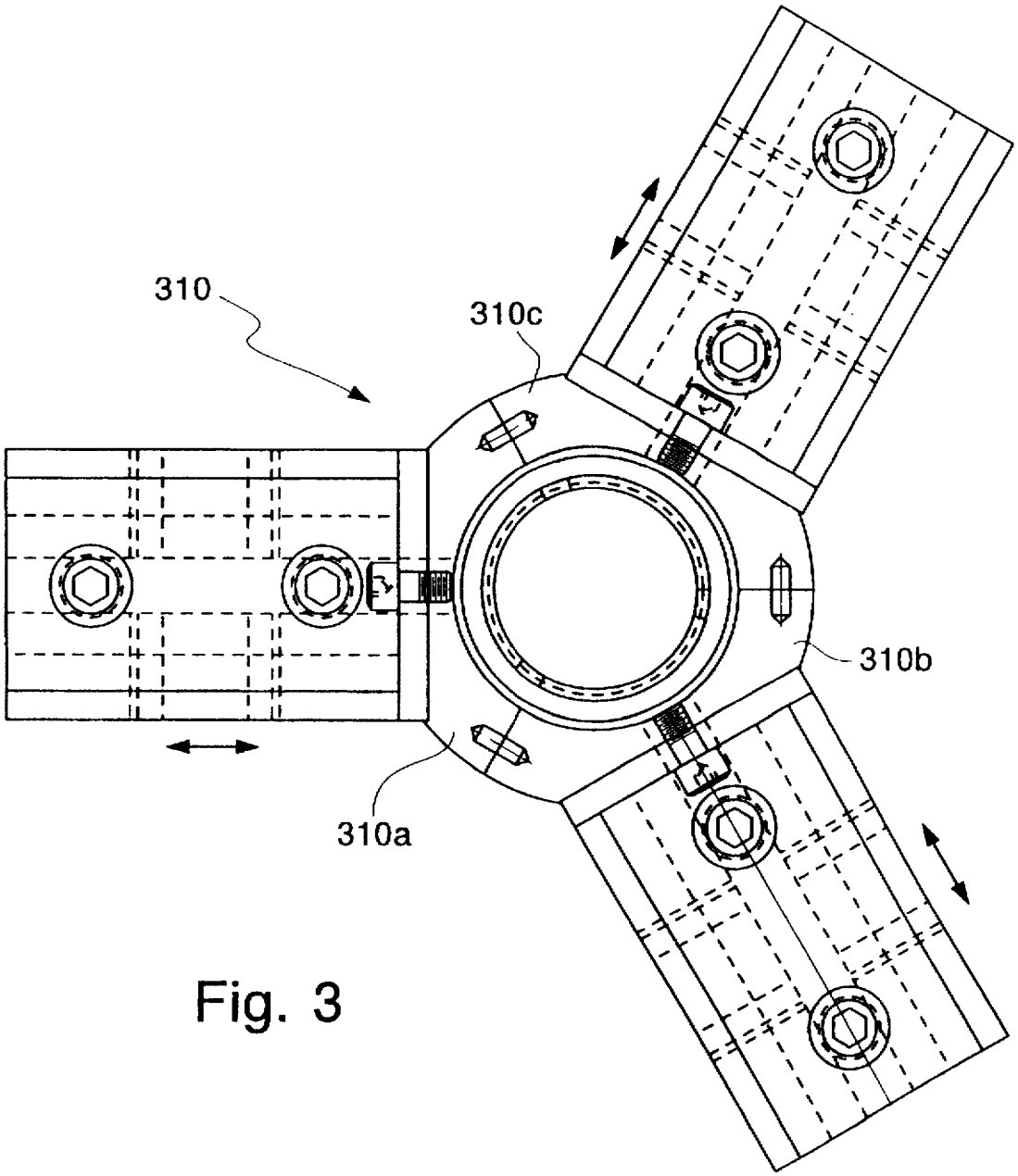
FIG. 3 is a top view of a three-die arrangement useful in a production implementation of one embodiment of a container body reshaping apparatus.

FIG. 3 illustrates a die assembly 310 having three die members 310*a*, 310*b*, 310*c* which are each disposed for radial advancement into the position illustrated for shaping/embossing operations, and retraction for removal of a shaped/embossed container body and loading of the next cylindrical container body to be shaped. It is believed that provision of three or more die members in such a retractable arrangement will reduce undesirous scratching or other contact between the external sidewall surface of a container body and the inner surfaces presented by die assembly 310 upon completion of shaping/embossing operations. More generally, and as noted above, it should be appreciated that in a production implementation, the initial positioning of container bodies, advancement/retraction of die assemblies, advancement/retraction of spray assemblies, rotation of spray assemblies, supply of fluid to spray assemblies, and removal of shaped container bodies after completion of shaping/embossing operations can be automated.

Figure 4B:
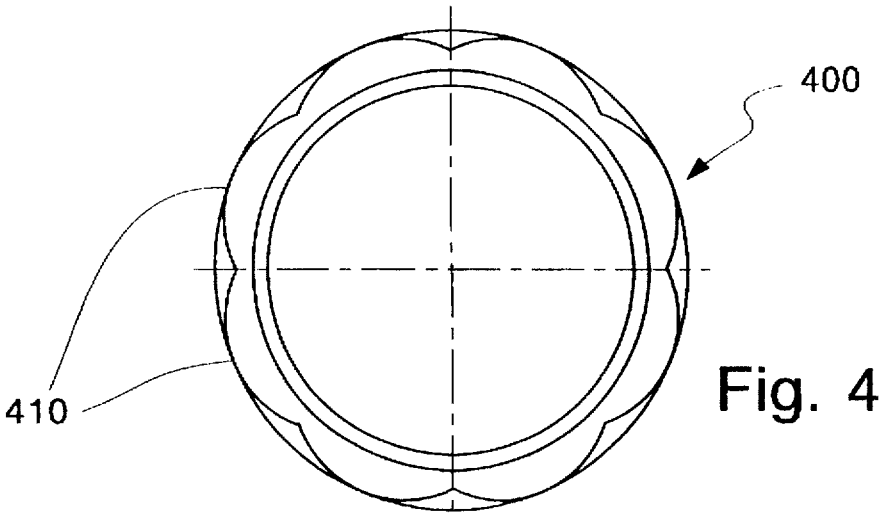
FIGS. 4A and 4B, and FIGS. 5A and 5B, illustrate side and top views of two different container bodies having different complex shapes and designs achievable through use of one or more aspects of the present invention.
Figure 4A:
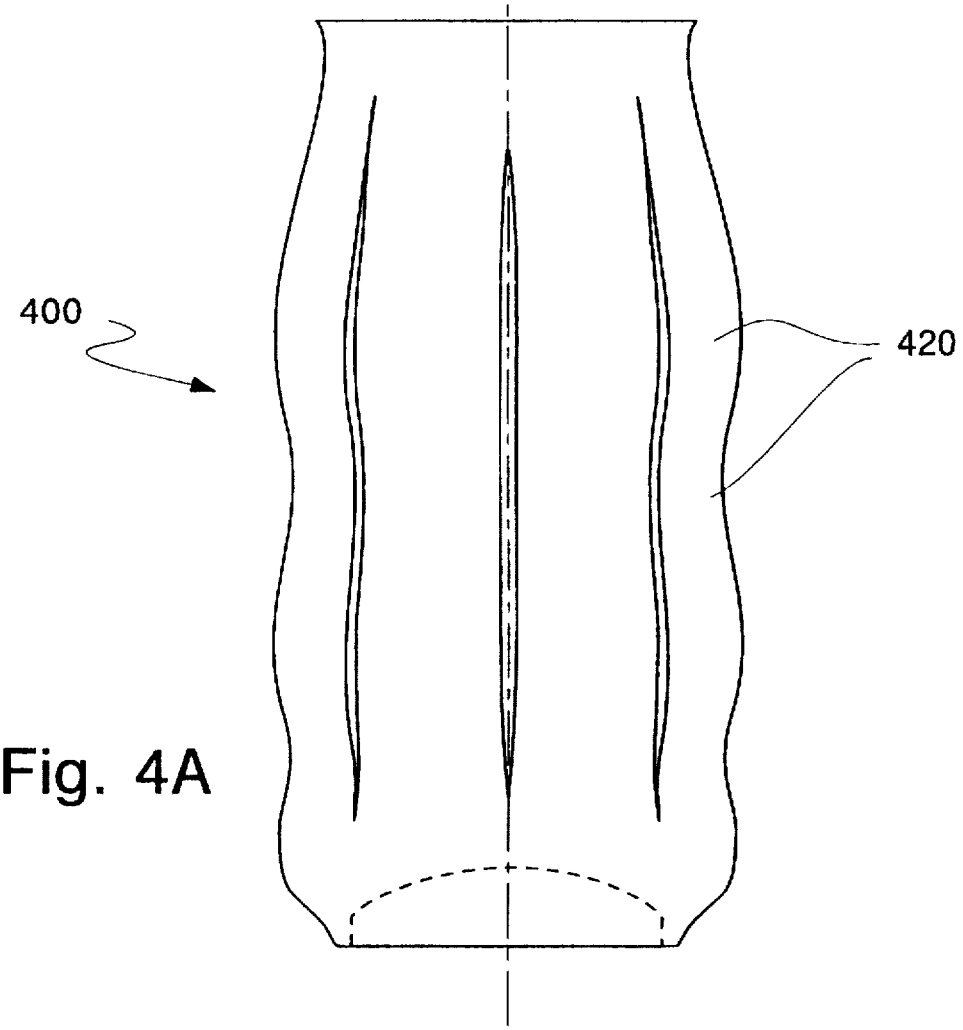

FIGS. 4A–4B and FIGS. 5A–5B illustrate two container body configurations achievable through use of the present invention. More particularly, FIGS. 4A and 4B illustrate a container body 400 having vertical ribs 410 and surfaces of revolution 420. As shown, the diameter of the ribs 410

Figure 5B:
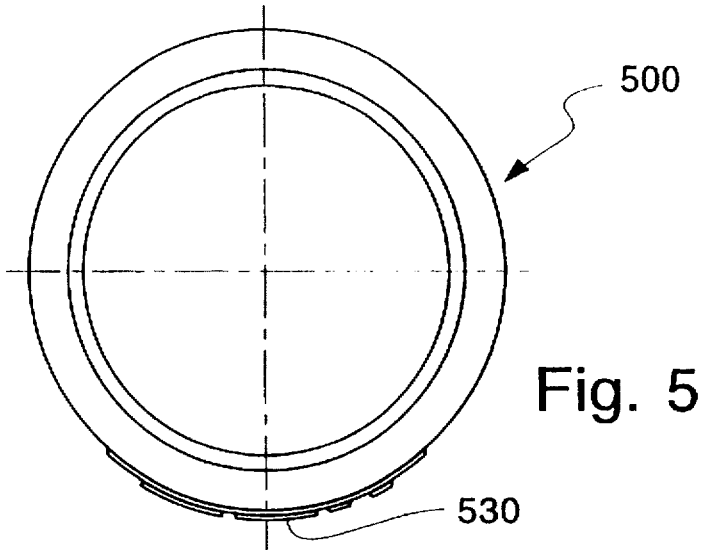
Figure 5A:
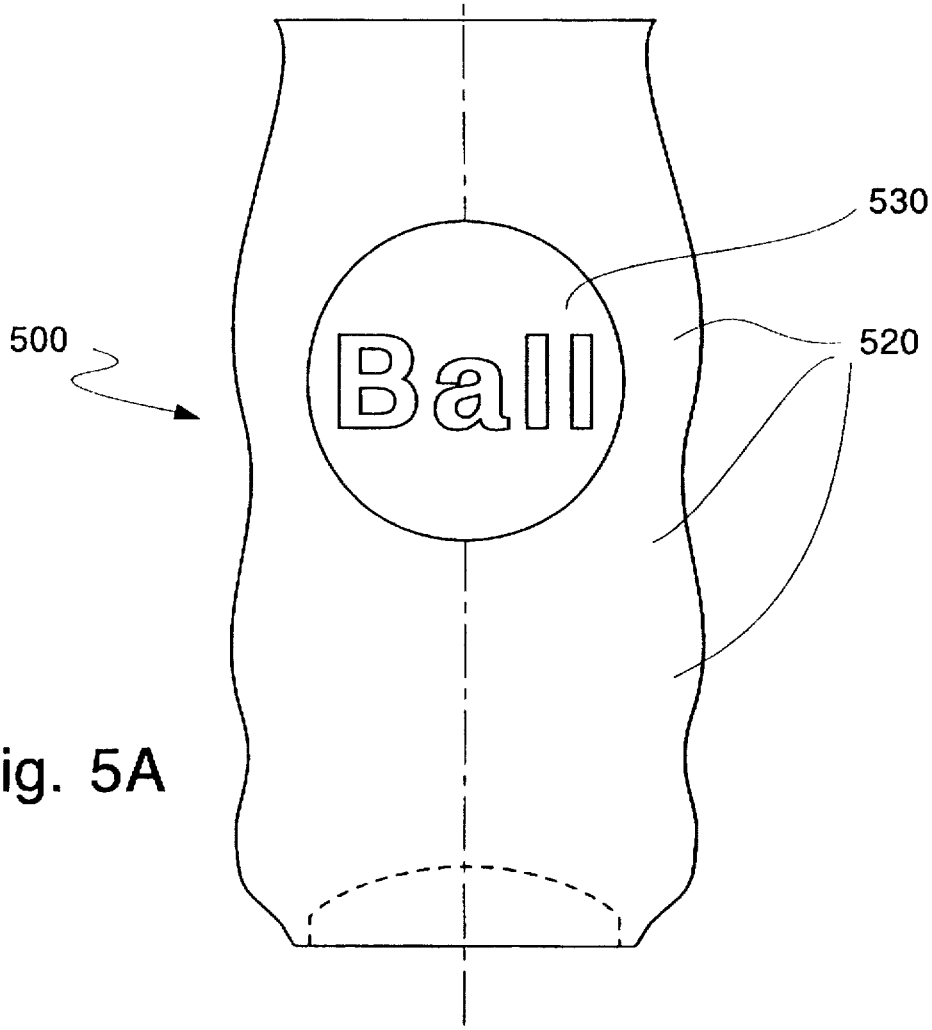

(relative to the center axis of container body 400) varies along the vertical extent of the container body 400. FIGS. 5A and 5B illustrate a container body 500 having surfaces of revolution 520 and a company name/logo 530 selectively embossed in a sidewall thereof.

Figure 6:
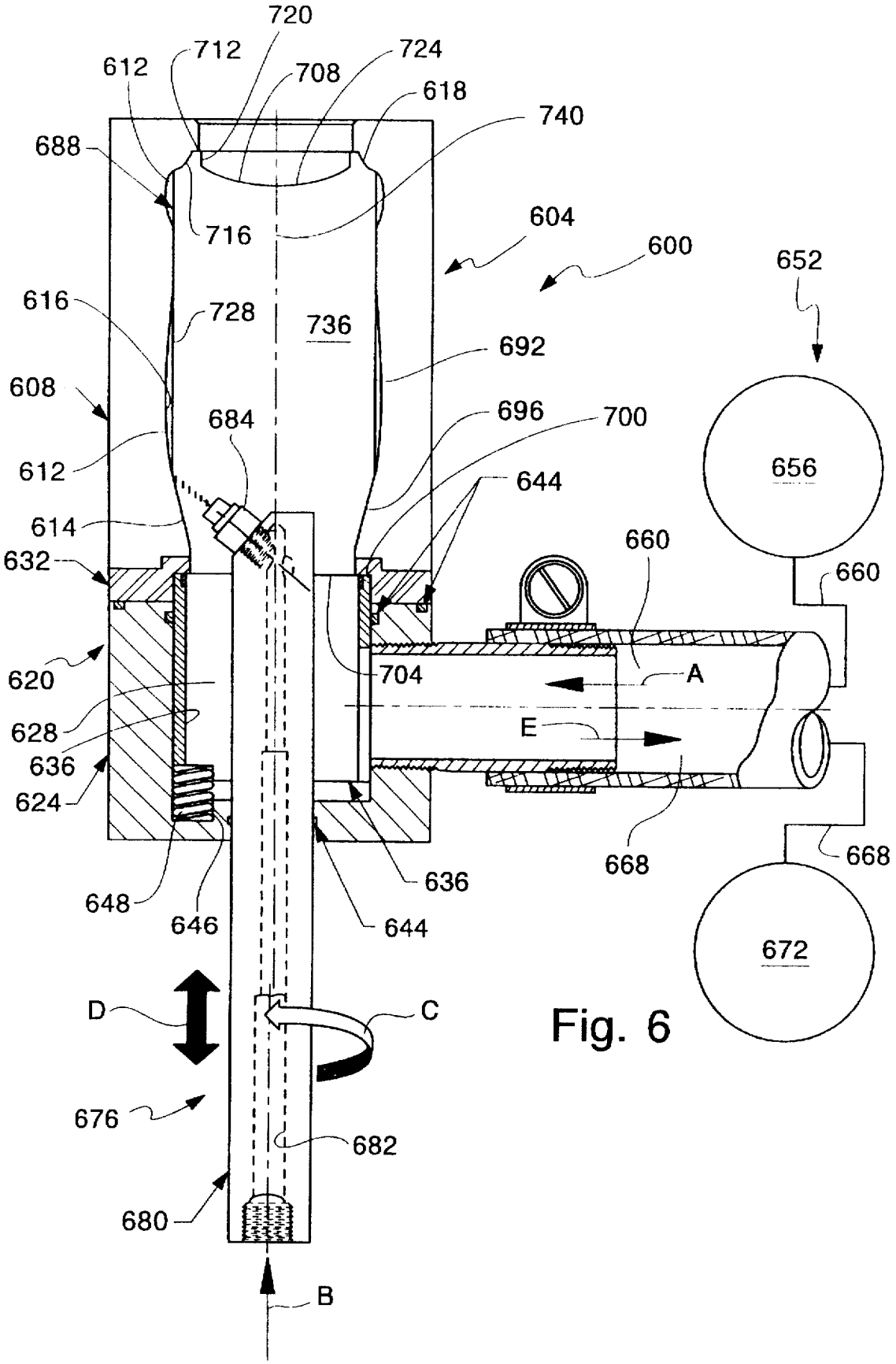
FIG. 6 is a cross-sectional view of another embodiment of a container body reshaping apparatus.

Another embodiment of a container body reshaping apparatus is illustrated in FIG. 6. The reshaping assembly 600 of FIG. 6 generally includes a mold or die assembly 604 to hold a container body 688 (e.g., having a sidewall thickness no greater than about 0.0070 inch) to be reformed and to provide surfaces corresponding with the desired configuration for the container body 688 after reformation. Multiple fluids are used in the reshaping operation provided by the reshaping assembly 600. One fluid is used by a pressurization assembly 652 to pressurize an interior 736 of the container body 688 to "control" or "hold" the particular surface of the container body 688 being actively reshaped. This pressurization assembly 652 utilizes a seal assembly 620 to effectively seal the interior of the container body 688 during use of the pressurization assembly 652. Another fluid is used by a spray assembly 676 to apply a primary reshaping force on a surface of the container body 688 and to cause the container body 688 to interact with the die assembly 604 and reshape the same. Typically, the pressurization assembly 652 is operated throughout at least a substantial portion of, and typically the entirety of the operation of the spray assembly 676 when reforming the container body 688. Fluid from at least the spray assembly 676 is removed from the container body 688 during reshaping operations by a drain assembly 664.

The container body 688 is substantially the same as the container body 40 noted above, but will be briefly addressed to assist in the understanding of one or aspects of the reforming assembly 600. The container body 688 is metal and formed by a drawing and ironing operation. As such, the container body 688 includes a generally cylindrical sidewall 692, a bottom or closed end 708 integrally formed with the sidewall 692, and an open end 704 opposite the bottom end 708. The thickness of the sidewall 692 is typically less than that of the bottom end 708, and in one embodiment the sidewall 692 has a thickness which is no more than about 0.006 inch.

An upper portion of the sidewall 692 of the container body 688 includes a neck 696, which reduces the diameter of the end piece (not shown) required to seal the container body 688 after being "filled", and a flange 700, which assists in the seaming of this end piece onto the container body 688 and which defines the open end 704. The bottom end 708 includes an exteriorly, convexly-shaped annular support or nose 712 which is integrally interconnected with a lower portion of the sidewall 692 by an annular transition wall 716 which forms part of the bottom end 708. The bottom end 708 further includes a central panel 724 which is disposed above the nose 712 by a generally linear inner wall 720.

The container body 688 to be reshaped is retained at least in part in the mold or die assembly 604. The die assembly 604 includes a mold or die 608 having a mold or die cavity 612 defined by a contoured surface 616. Portions of the container body 688 are radially spaced from the contoured surface 616 to allow portions of the container body 688 to be forced radially outwardly into conformance with corresponding portions of the contoured surface 616 to provide a desired shape for the container body 688 after reshaping. It is generally desirable for any fluids (e.g., air) which may be trapped in the area between the container body 688 and the die 608 to be vented in some manner.

Other portions of the container body 688 are initially supported by the contoured surface 616. In this regard the contoured surface 616 includes a nose seat 618 which is substantially flush with the transition wall 716 and at least a portion of the nose 712 of the container body 688. The contoured surface 688 further includes a neck seat 614 which is substantially flush with a substantial portion of the neck 696 of the container body 688. Seats 614 and 618 serve to control the positioning of the container body 688 during reshaping operations, and the nose seat 618 further may be utilized in applying an axially-directed "pre-load" to the container body 688 prior to initiating reshaping operations in a manner discussed in more detail below. Characteristics of the die assembly 10 (FIGS. 1A–D), the die assembly 110 (FIG. 2), and the die assembly 312 (FIG. 3) discussed above may also be utilized in the die assembly 604, including having the die 608 be formed in multiple parts for loading/removal of the container body 688 (i.e., the die 608 may be formed in three separate and radially movable die sections).

The mold or die assembly 604 interacts with the seal assembly 620 to allow the container body 688 to be pressurized with one fluid (via the pressurization assembly 652) prior to being principally reshaped by another fluid (via the spray assembly 676). In this regard, the lower portion of the die 608 includes a neck ring 632 which may be integrally formed with the die 608 or separately attached thereto. Various partitions (not shown) are utilized to allow the neck ring 832 to be split, along with the die 608, for loading of the container body 688 within the die assembly 604.

The neck ring 632 interfaces with a seal housing 624 of the seal assembly 620. This seal housing 624 includes a seal housing cavity 628 for introducing the pressurized fluid from the pressurization assembly 652 into the container body 688 through its open end 704. Various O-rings 644 may be disposed between the neck ring 632 and the seal housing 624 to provide an appropriate seal therebetween during use of the pressurization assembly 652.

The neck ring 632 of the die assembly 604 also conformingly interfaces with and supports an upper portion of the neck 696 and flange 700 of the container body 688. The flange 700 of the container body 688 is actually retained between the split neck ring 632 and a generally cylindrical inner seal 636 which is disposed inside the seal housing 624. one or more springs 648 (one shown) is seated within an appropriately shaped spring cavity 646 within the seal housing 624 and biases the inner seal 636 against the flange 700 of the container body 688 to forcibly retain the flange 700 between the. neck ring 632 and the inner seal 636. This effectively seals the interior 736 of the container body 688 during use of the pressurization assembly 652. In one embodiment,.the spring 648 applies a force ranging from about 10 to about 50 pounds on the flange 700 to retain the same between the inner seal 636 an the neck ring 632. This may also bias the container body 688 against the nose seat 618 of the die 608 to axially pre-load the same.

The pressurization assembly 652 pressurizes the interior 736 of the container body 688 or exposes certain portions of the container body 688 to a pressurized fluid to "hold" or "control" the metal during reforming of the container body 688 with the spray assembly 676. Operational pressures used by the pressure assembly 652 are substantially less than those used by the spray assembly 676 (e.g., ranging from about 0.5% to about 6% of the pressures used by the spray assembly 652), such that hereafter the pressure assembly 652 may be referred to as using a low pressure fluid and the spray assembly 676 may be referred to as using a high pressure, high velocity fluid. The pressurization assembly 652 may also be characterized as functioning to improve the formability of the container body 688 through use of the spray assembly 676, to reduce the potential for "springback" of the container body 688 after it is reformed, to potentially allow for a reduction in the pressure used by the spray assembly 676 in comparison with the above-discussed embodiments, to improve upon the surface finish of the container body 688 after reformation, and to reduce the number of passes required by the spray assembly 676 in comparison with the above-discussed embodiments. It should than be appreciated that the pressurization assembly 652 may be used with the spray assemblies 20 and 120 discussed above.

The pressurization assembly 652 includes a pressure source 656 (e.g., a compressor) which contains an appropriate fluid and which is fluidly interconnected with the sealing cavity 628, and thereby the interior 736 of the container body 688, by a pressure line 660. This pressure line 660 extends through the seal housing 624 and through an appropriate opening in the inner seal 636, and flow is in the direction of the arrow A. Preferably, the fluid used by the pressurization assembly 652 is a gas, and is more preferably air. In one embodiment, the pressurization assembly 652 introduces a fluid (e.g., a gas such as air) into the interior 736 of the container body 688 to expose substantially an entirety of an interior surface 728 of the container body 688 to a fluid pressure (e.g., air pressure) which is preferably substantially constant, which will create a tensile hoop stress in the container wall, and which is within the range of about 10% to about 50% of the yield strength of the container body 688. In one embodiment, the pressure within the interior 736 of the container body 688 is substantially constant and within the range of about 20 psi to about 100 psi, in another embodiment is substantially constant and within the range of about 30 psi to about 60 psi, and in yet another embodiment is substantially constant and no greater than about 40 psi. The pressure within the interior 736 may also increase in a controlled manner during the reshaping process or use of the spray assembly 676. During introduction of fluids into the interior 736 of the container body 688 by the spray assembly 676, the pressure within the interior 736 will increase above that provided by the pressurization assembly 652. A pressure relief valve may be utilized to limit the pressure rise to a predetermined value (e.g., within the noted ranges or less than 100 psi). Throughout at least a substantial portion of and typically the entire operation of the spray assembly 676 when reforming the container body 688, preferably the pressure within the interior 736 of the container body is maintained at a substantially constant value by the pressurization assembly 652. As such, the fluid pressure provided by the pressurization assembly 652 may be characterized as being substantially static during the reshaping process.

The spray assembly 676 generates and applies the primary reshaping force to the interior surface 728 of the container body 688, and may utilize each of the various aspects of the spray assembly 20 and spray assembly 120 discussed above. Generally, the spray assembly 676 includes a spray wand 680 which extends through the lower portion of the seal housing 624 and into the interior 736 of the container body 688, and which has at least one spray nozzle 684. An appropriate fluid, preferably a liquid such as water, is directed up through an interior conduit 682 of the wand 680 in the direction of the arrow B and out each of the spray nozzles 684 to exert a reshaping force on the interior surface 728 of the container body 688. This then forces the impacted portion of the container body 688 radially outwardly into substantial conforming engagement with a corresponding portion of the contoured surface 616 of the die 608. As above, relative rotation and longitudinal movement between the spray assembly 676 and the container body 688 allows the spray nozzle(s) 684 to direct fluid against substantially the entire interior surface 728 of the sidewall 692 of the container body (e.g., by rotating the spray wand 680 about a center of rotation corresponding with the central, longitudinal axis 740 of the container body 688 in the direction of the arrow C, and simultaneously axially advancing the spray wand 680 into and out of the interior 736 of the container body 688 in the direction of the arrow D at least once, and typically a plurality of times).

Fluid discharged from the spray nozzle(s) 684 impacts a relatively small portion of the interior surface 728 of the container body 688 with a concentrated force. There are a number of contributing factors. Initially, in one embodiment each spray nozzle 684 is spaced from the interior surface 728 of the sidewall 692 of the container body 688 a distance within the range of about ⅛" to about ¾", and more preferably within the range of about ¼" to about ½". Fluid from the spray assembly 676 thereby travels through the fluid from the pressurization assembly 652, which is also within the interior 736 of the container body 688 and which is typically air, to impact the container body 688 to reform the same.

Another factor which contributes to the application of a concentrated force on the container body 688 by the spray assembly 676 is that the fluid discharged from each of the spray nozzles 684 (e.g., water) and onto the container body 688 is in the form of a high velocity fluid stream. This fluid stream in one embodiment has a width ranging from about 0.040 inches to about 0.150 inches when it impacts the interior surface 728 of the container body 688, and the area of the container body 688 impacted by each fluid stream from the spray assembly 676 may range from about 0.0015 $in^2$ to about 0.050 $in^2$. The pressure acting on the interior surface 728 of the container body 688 where impacted by a fluid stream in one embodiment ranges from about 1,000 psi to about 5,000 psi. A lower pressure requirement for the spray force to reshape the metal can be produced by use of the internal air pressure in the can which will produce a tensile hoop stress in the can wall.

The use of the pressurization assembly 652 with the spray assemblies, 20, 120, and 676 provides certain benefits to the overall reforming process. Using the pressurization assembly 652 during operation of the spray assemblies 20, 120, and 676 provides an improved surface finish for the reformed container body compared to when the pressurization assembly 652 is not used. Furthermore, the power requirements of the spray assemblies 20, 120, and 676 may be reduced through use of the pressurization assembly 652, such as by reducing the fluid pressure required for effective operation thereof as noted above. Use of the pressurization assembly 652 may also reduce the amount of time required for the overall reforming process, such as by reducing the number of "strokes" of the spray wand 680 (i.e., the number of times which the spray wand 680 must be inserted into and withdrawn from the interior 736 of the container body 688).

Fluid from the spray assembly 676 is removed from the interior 736 of the container body 688 by the drain assembly 664, specifically after this fluid from the spray assembly 676 has impacted the interior surface 728 of the container body 688. A drain line 668 extends through the seal housing 624 and fluidly interconnects the seal housing cavity 628 and a drain tank 672. The drain line 668 may be disposed adjacent to the pressure line 660. This drain tank 672 may be pressurized, such as at about 45 psi. Fluid from the spray assembly 676 thereby falls into the seal housing cavity 628 and flows through the drain line 668 in the direction of the arrow E to the drain tank 672.

Reshaping operations with the reshaping assembly 600 will now be summarized. Loading the container body 688 into the die 608 requires that the die 608 be opened (i.e., radially separated into at least two, and preferably three different parts), and further that the die assembly 604 and the seal housing 624 be axially separated or spaced. Thereafter, the die 608 may be closed and the seal housing 624 may move into engagement with the die assembly 608. This may subject the container body 688 to an axially-compressive force to pre-load the container body 688 as noted above. Moreover, this also seals the interior 736 of the container body 688 for activation of the pressurization assembly 652. Specifically, the flange 700 of the container body 688 is forcibly retained between the neck ring 632 of the die assembly 604 and the inner seal 636 of seal assembly 620 by the action of the spring(s) 648 to effectively allow the interior 736 of the container body 688 to be pressurized.

The pressurization assembly 652 is activated to introduce fluid (e.g., air) into the seal housing cavity 628 and then the interior 736 of the container body 688. The gas fluid pressure within the interior 736 of the container body 688 is comparatively low in relation to the spray pressure from the spray assembly 676, is typically insufficient to cause the container body 688 to conform to the contoured surface 616 of the die 608, and is maintained at a substantially constant level. This further "pre-loads" the container body 688 and effectively functions to "hold" or "control" those portions of the container body 688 which are impacted by the fluid stream from the spray nozzles 684 of the spray assembly 676. Again, the fluid stream from the spray nozzle 684 only acts upon a small portion of the interior surface 728 of the container body 688 at any given instance. The spray wand 680 may be rotated along an axis which coincides with central, longitudinal axis 740 of the container body 688 and may be axially advanced within and retracted from the interior 736 of the container body 688 to reshape the same (an inward extension and subsequent retraction of the wand 680 comprising a stroke, and multiple strokes may be utilized). Fluids from the spray assembly 676 are removed from the interior 736 of the container body 688 by falling within the seal housing cavity 628 and out the seal housing 624 via the drain line 668.

Figure 7A:
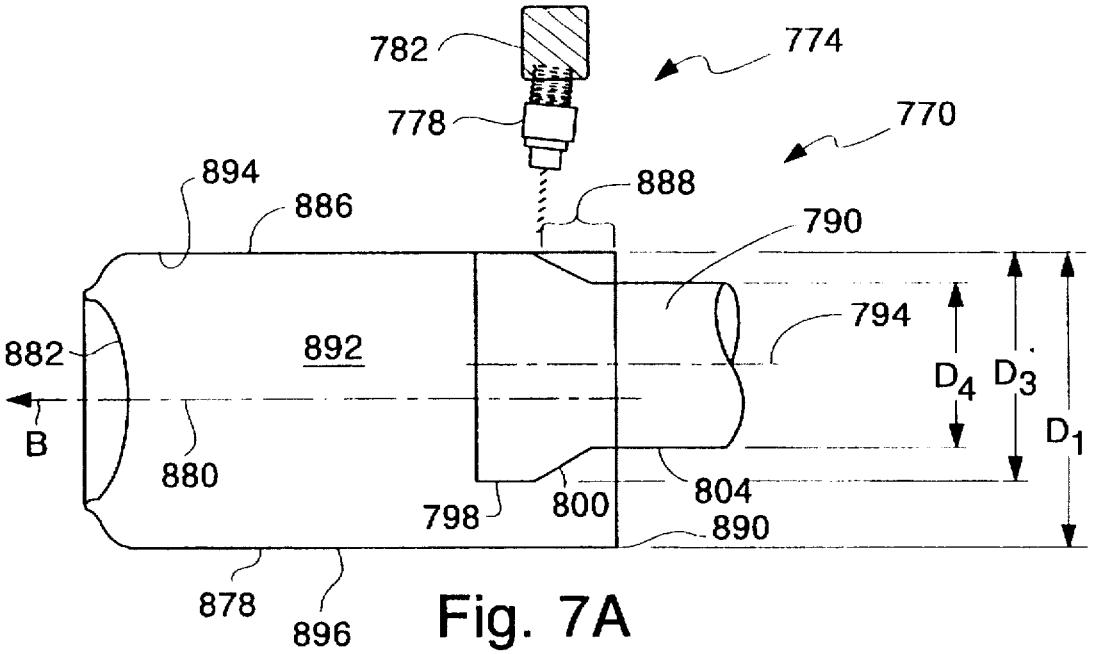
FIG. 7A is a side view of one embodiment of a necking apparatus at the start of necking operations.
Figure 7B:
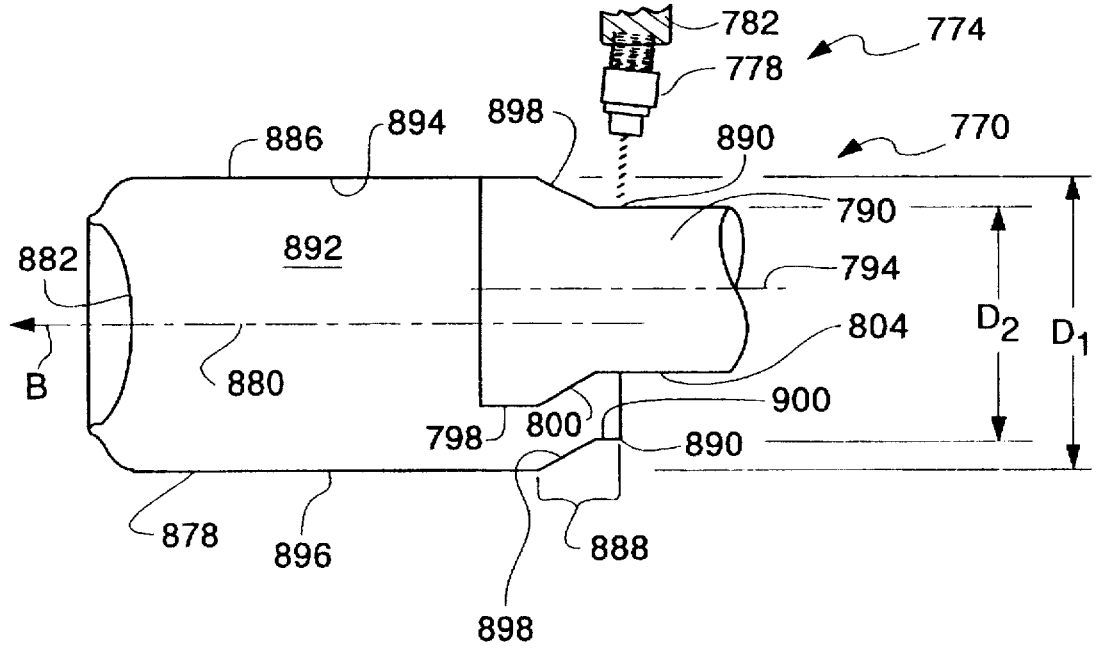
FIG. 7B is a side view of the necking apparatus of FIG. 7A at the end of necking operations.

Another embodiment of a container body reshaping apparatus is illustrated in FIGS. 7A–B in the nature of a necking assembly 770. A drawn and ironed container body 878 is also illustrated in FIGS. 7A–B. In FIG. 7A, the container body 878 is illustrated in its "unnecked" condition and in FIG. 7B the container body 878 is illustrated in its "necked" condition. The "unnecked" drawn and ironed container body 878 includes a bottom 882 and generally cylindrical sidewall 886 which is disposed about a container body central axis 880, which is integrally formed with the bottom 882 and which in one embodiment has a sidewall thickness no greater than about 0.0070 inch. The upper portion of the sidewall 886 defines an open end 890 having a diameter $D_1$. An interior surface 894 of the container body 878 interfaces with the contents provide thereto (e.g., beverages), while an exterior surface 896 defines the "public" side of the container body 878 or that side which is engageable by the consumer when handling the container body 878.

The necking assembly 770 exerts forces on the exterior surface 896 of the container body 878 to symmetrically reduce the diameter of the open end 890 from the diameter $D_1$ to the diameter $D_2$ which is smaller than the diameter $D_1$ (FIG. 7B). This function is provided by forming a generally frustumly-shaped, annular neck 898 on an upper portion of the sidewall 886 of the container body 878 or from at least a portion of a longitudinal section 888 of the sidewall 886. "Longitudinal" in this case means a section which has a length in a direction which is substantially parallel with the container body central axis 880. The neck 898 formed on the container body 878 extends from the sidewall 886 inwardly toward the container body central axis 880. Typically, a flange section 900 will also extend from the upper extreme of the neck 898 in an orientation which is generally parallel with the container body central axis 880, and thereby in a different orientation than the neck 898. This flange section 900 is for forming a flange which is used to seam a separate end piece (not shown) onto the container body 878 after being "filled", or could be the flange itself. That is, the necking assembly 770 could possibly be adapted to at least partially form this flange from the flange section 900 such that it would extend from the upper end of the neck 898 generally away from the container body central axis 880.

Figure 8:
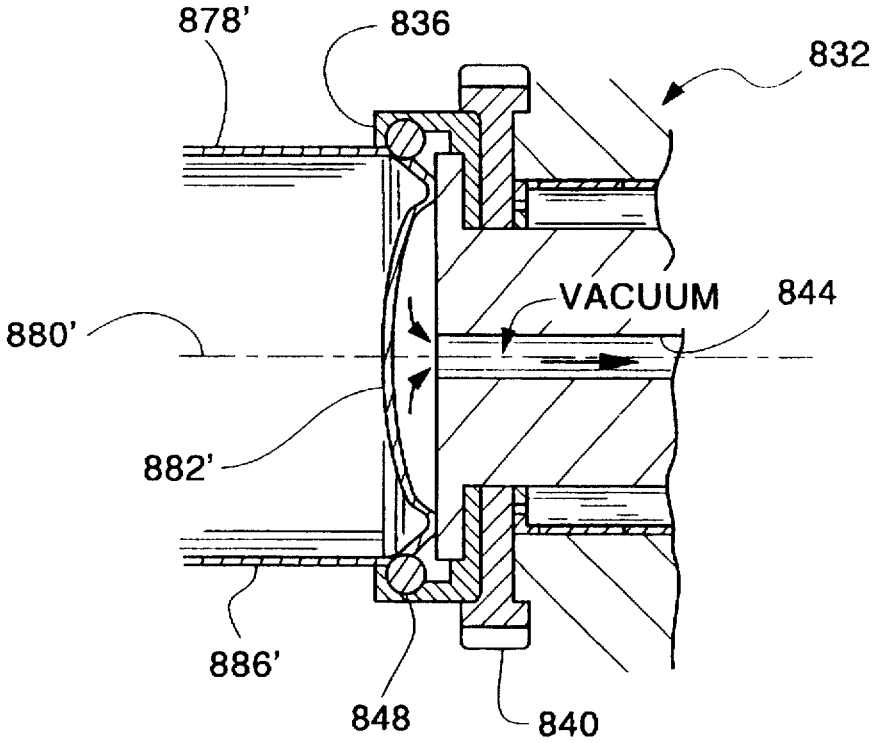
FIG. 8 is a cross-sectional view of one embodiment of a container body holder which may be used with the necking apparatus of FIGS. 7A–B.

Components of the necking assembly 770 include a container body holder assembly 832 (FIG. 8) and a spray assembly 774 (FIGS. 7A–B). The container body holder assembly 832 is illustrated in FIG. 8 and generally maintains the container body 878 in proper position for necking by the necking assembly 770 by engaging its bottom 882. This container body holder assembly 832 is described in more detail in U.S. Pat. No. 4,781,047, issued Nov. 1, 1988, the entire disclosure of which is incorporated by reference herein. The profile of the container body 878' illustrated in FIG. 8 is slightly different than that of the container body 878 illustrated in FIGS. 7A–B, and therefore a "single prime" designation is used in FIG. 8. The holder assembly 832, however, will be discussed in relation to the container body 878.

The container body holder assembly 832 generally includes a housing assembly 836 which is rotated by a gear 840 to rotate the container body 878 relative to the spray assembly 774. A portion of the bottom 882 of the container body 878 engages part of the housing assembly 836 (e.g., the lowest extreme) and the juncture between the bottom 882 and sidewall 886 is also engaged by an O-ring 848. The O-ring 848 provides a seal such that a vacuum may be drawn through a vacuum passage 844 through the housing assembly 836 to securely retain the container body 878 against the container body holder 832.

The spray assembly 774 is disposed exteriorly of the container body 878 and applies a force thereto to reduce the diameter of its open end 890. The spray assembly 774 includes a nozzle mount ring 782 having a single spray nozzle 778 mounted thereon. The spray nozzle 778 generally conforms with the characteristics of the nozzles 22 and 684 described above, such as the fluids used thereby (e.g., water), the types of spray patterns which may be utilized (e.g., stream of fluid, "size" of the fluid as it impacts the container body 878), the nozzle operating pressures (e.g., the velocity at which the fluid stream impacts the container body 878), and the spacing from the container body 878 when first initiating contact therewith. However, in one embodiment the spray assembly 774 operates in the following manner for necking operations: I) the operating pressure associated with the spray nozzle 778 ranges from about 1,000 psi to about 10,000 psi, and more typically from about 2,000 psi to about 5,000 psi; ii) the fluid velocity is from about 375 feet per second to about 1,100 feet per second, and more typically from about 550 feet per second to about 860 feet per second; iii) the size of the nozzle 778 ranges from about 0.050 inch diameter to about a 0.120 inch diameter; iv) either a straight or fan pattern is used to form the neck profile; and v) the nozzle 778 is spaced from about ⅛ inch to about 1 inch from the wall of the container body 878 throughout the necking operation.

Generally, the spray nozzle 778 directs a high-velocity fluid stream against a discrete portion of the upper portion of the sidewall 886 of the container body 878. This exerts a force on the exterior surface 896 of the container body 878 which is generally directed toward the container body central axis 880. Moreover, the spray nozzle 778 may also be oriented on the nozzle mount ring 782 to also have the force vector provided by-the high-velocity fluid stream be further directed generally in the direction of the bottom 882 of the container body 878.

Several general machine functions are required in a commercial setting to assist in the formation of the neck 898 from the sidewall 886 of the container body 878 using at least one high velocity fluid stream acting on the exterior surface 896 of the container body 878. Principally, there must be some method of controlling the metal during the neck forming operation to insure that a suitable neck profile in created by the action of the spray stream(s) in a controlled fashion. In addition, in order to form the neck 898 either the container body 878 or the spray nozzle(s) must be rotated, and either the container body 878 or the nozzle(s) must be axially advanced in a controlled fashion to apply the force of the spray stream(s) along the relevant length of the container body 878 in order to progressively "work" the metal into the desired neck profile.

The wall of the container body 878 must also be prevented from wrinkling, buckling or otherwise distorting in an undesirable manner in a commercial setting. Several methods may be appropriate for controlling the wall of the container body 878 during the neck forming operation to prevent the metal from wrinkling and to assist in the formation of the desired neck profile. These methods may include disposing one or more mandrels inside the container body 878. The mandrels may be concentric or eccentric to the container body central axis 880 of the container body 878, or one mandrel may be concentric and one eccentric to the container body central axis 880. Rollers may be used inside the container body 878 or in conjunction with a mandrel. A tool may be used which captures the cut edge of the container body 878 before initiation of the necking operation and which maintains control of the open end of the container body during the necking operation. It may be desirable to use a fluid pressure inside the can to control the metal as well.

The necking assembly 770 also includes a mandrel 790 which is disposed within the interior 892 of the container body 878 and which provides at least a degree of "control" to at least certain relevant portions of the container body 878 during necking operations. The mandrel 790 includes a first mandrel section 798 which is substantially cylindrical about a mandrel central axis 794. The first mandrel section 798 is defined by a diameter $D_3$ which is less than the diameter $D_1$ of the open end 890 of the container body 878 prior to starting necking operations. The diameter $D_3$ of the first mandrel section 798 is also less than the diameter $D_2$ of the open end 890 of the container body 878 at the completion of necking operations. This allows the mandrel 790 to be removed from the interior 892 of the container body 878 without exerting any forces on the same.

Only a portion of any annular or circumferential section of the interior surface 894 of the container body 878 is supported by the first mandrel section 798 at any one time throughout necking operations with the necking assembly 770. Typically the "center" of this portion of the interior surface 894 of the container body 878 is contained within a reference plane which extends radially outwardly form the container body central axis 880 through the spray nozzle 778 (e.g., the mandrel 790 and the spray nozzle 778, specifically the vector of the fluid stream ejected therefrom, are radially aligned). The radial position of the mandrel 790 actually remains fixed relative to the radial position of the spray nozzle 778 throughout reshaping operations to allow the mandrel 790 to provide its "control" function. With there being relative rotational movement between the spray nozzle 778 and the container body 878 to allow the single spray nozzle 778 to reform an annular portion of the sidewall 886 as will be discussed in more detail below, there is then relative rotational movement between the container body 878 and the mandrel 790 as well. There is no relative axial or longitudinal movement between the mandrel 790 and the container body 878 during necking operations such that the axial position of the mandrel 790 remains fixed relative to the axial position of the container body 878 while being reshaped by the spray nozzle 778 which does move axially relative to the container body 878 as will be discussed in more detail below.

The mandrel 790 further includes a second mandrel section 800 which defines the profile for the neck 898 of the container body 878. As such, the second mandrel section 800 is generally frustumly-shaped substantially concentrically about the mandrel central axis 794 in that it extends from the first mandrel section 798 generally inwardly toward the mandrel central axis 794 at a substantially constant angle and symmetrically relative to the axis 794 (e.g., the maximum diameter of the second mandrel section 800 is $D_3$ which is the diameter of the first mandrel section 798). All portions of the second mandrel section 800 are spaced from the interior surface 894 of the container body 878 at the start of necking operations as illustrated in FIG. 7A. This allows the longitudinal section 888 of the sidewall 886 to be forced radially inwardly toward the container body central axis 880 "unrestrained" by the mandrel 790 until it contacts the second mandrel section 800. No opposing forces are provided by the second mandrel section 800 on the container body 878 until the spray nozzle 778 has forced a corresponding portion of the longitudinal section 880 into substantial conforming engagement with the second mandrel section 800.

The mandrel 790 further includes a third mandrel section 804 which is used to define the profile for the flange section 900 which extends from the neck 898 of the container body 878 (FIG. 7B). The third mandrel section 804 extends from the end of the second mandrel section 800, and in the illustrated embodiment is substantially cylindrical in concentric fashion about the mandrel central axis 794. This configuration for the third mandrel section 804 provides a profile for the flange section 900 which is substantially cylindrical in concentric fashion about the container body central axis 880. Other profiles could be utilized for the third mandrel section 804 to provide a corresponding change in the profile of the flange section 900 of the container body 878. A profile for the flange section 900 in which the flange section 900 extended from the neck 898 radially outwardly relative to the container body central axis 880 could possibly be provided by configuring the third mandrel section 804 to be substantially frustumly-shaped and concentric about the mandrel central axis 794, and having the third mandrel section 804 extend from the second mandrel section 800 radially outwardly from the mandrel central axis 794.

The third mandrel section 804 illustrated in FIGS. 7A–B is defined by a diameter $D_4$ which is less than the diameter $D_3$ of the first mandrel section 798. All portions of the third mandrel section 804 are spaced from the interior surface 894 of the container body 878 at the start of necking operations.

This allows corresponding portions of the longitudinal section 888 of the sidewall 886 to be forced radially inwardly toward the container body central axis 880 "unrestrained" by the mandrel 790 until it contacts the third mandrel section 804. No opposing forces are provided by the third mandrel section 804 on the container body 878 until the spray nozzle 778 has forced-a corresponding portion of the longitudinal section 888 into conforming engagement with the third mandrel section 804.

In summarizing a necking procedure with the necking assembly 770, a container body 878 having a generally cylindrical sidewall 886 with an open end 890 having a diameter $D_1$ is mounted on the container body holder 832 (FIG. 8). Application of a vacuum through the vacuum passage 844 pulls the container body 878 toward and into firm engagement the container body holder assembly 832. The initial relative axial or longitudinal position between the container body 878 and the spray nozzle 778 is such that when fluid is directed from the spray nozzle 778 toward the container body 878, the fluid will impact the exterior surface 896 of the container body 878 at a location which is axially spaced from the open end 890 of the container body 878.

The mandrel 790 is disposed within the interior 892 of the container body 878 typically after the container body 878 is engaged by the container body holder 832. Relative longitudinal or axial movement is used to advance the mandrel 790 through the open end 890. By having the mandrel central axis 794 coincide with the container body central axis 880 during "loading" of the mandrel 790, the mandrel 790 may be inserted into the interior 892 of the container body 878 without contacting the container body 878. The mandrel 790 may then be moved radially outwardly relative to the container body central axis 880 and into a position where the first mandrel section 798 engages a portion of the interior surface 894 of the container body 878. This offsets the mandrel central axis 794 from the container body central axis 880. The second mandrel section 800, and typically the entirety of the third mandrel section 804, will be spaced from the interior surface 894 of the container body 878 at the start of necking operations. The portion of the first mandrel section 798 closest to the open end 890 of the container body 878 may be disposed close to but slightly spaced from the location where the fluid stream from the spray nozzle 778 will initially impact the exterior surface 896 of the container body 878.

The container body holder assembly 832 is rotated to rotate the container body 878 about the container body central axis 880. This provides relative rotational movement between the container body 878 and the spray nozzle 778 which is required to reform an annular portion of the sidewall 886 of the container body 878 with a high-velocity fluid stream which impacts only a small, discrete portion of the container body 878 at any one time. This also provides relative rotational movement between the container body 878 and the mandrel 790 to allow the mandrel 790 to "control" relevant portions of the sidewall 886 of the container body 878 during necking operations (e.g., the spray nozzle 778 is substantially radially aligned with at least a portion of the mandrel 790 throughout necking operations). The mandrel 790 may be "free spinning" at this time to freely rotate about its mandrel central axis 794. Fluid is then directed through the spray nozzle 778 which causes the fluid stream to impact a discrete portion of the exterior surface 896 of the sidewall 886 of the container body 878.

Through the relative rotational movement between the container body 878 and the spray nozzle 778, the impacting of the high velocity fluid stream on the sidewall 886 of the container body reforms an annular portion thereof. Specifically, this annular portion of the container body 878 is forced inwardly toward the container body central axis 880 until it engages a corresponding portion of the mandrel 790. Relative axial movement between the container body 878 and the spray nozzle 778 further allows the high-velocity fluid stream to also reform a longitudinal section 888 of the sidewall 886. This relative axial or longitudinal movement is in a direction which is generally parallel with the container body central axis 880 and may be provided by axially advancing the container body holder assembly 832 having the container body 878 secured thereto, as well as the mandrel 790, in the direction of the arrow B. Typically, both relative axial and rotational movement between the container body 878 and the spray nozzle 778 will be utilized to form the neck 898 on the container body 878. This causes the location where the high-velocity fluid stream impacts the sidewall 886 of the container body 878 to move progressively toward the open end 890 of the container body 878. In order to produce the neck 898, it may be necessary to reduce the speed at which the container body 878 is axially advanced relative to the spray nozzle 778 as the distance between the open end 890 and the location where the fluid stream impacts the exterior surface 896 decreases (e.g., reduce the relative axial speed as the region of impact of the fluid stream on the container body 878 gets closer to the open end 890).

The radial position of the spray nozzle 778 remains fixed relative to the radial position of the mandrel 790 throughout reshaping operations in the case of the necking assembly 770. This allows the mandrel 790 to "control" relevant portions of the sidewall 886 while being engaged by the fluid stream from the spray nozzle 778. Portions of the interior surface 894 of the container body 878, which are disposed adjacent to the location where the fluid stream is impacting the exterior surface 896 of the container body but slightly spaced therefrom, are supported by being engaged by either the first mandrel section 798, the second mandrel section 800, or the third mandrel section 804, depending upon the status of the necking operation. Again, the spray nozzle 778 moves axially relative to the mandrel 790 to allow the fluid stream to reform the longitudinal section 888 of the container body 878 by generally conforming the same to the first mandrel section 798, the second mandrel section 800, and/or the third mandrel section 804. At the completion of necking operations, relative radial movement between the container body 878 and the mandrel 790 disengages the mandrel 790 from the interior surface 894 and allows the mandrel 790 to be removed from the interior 892 of the container body 878 without contacting the same (e.g., by axially moving the mandrel 790 relative to the container body 878 along an axis which is substantially parallel with the container body central axis 880).

Figure 9A:
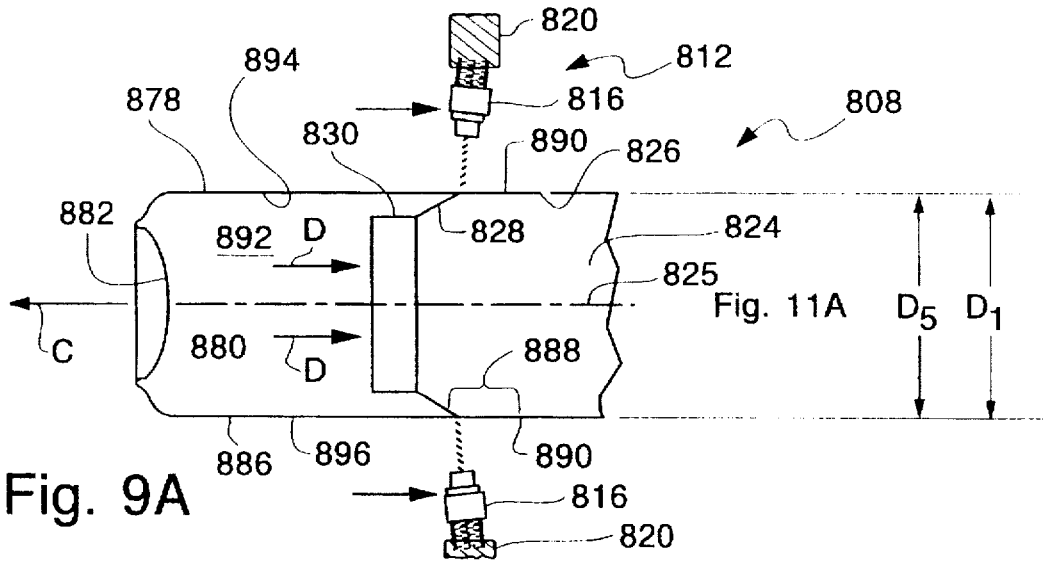
FIG. 9A is a side view of another embodiment of a necking apparatus.
Figure 9B:
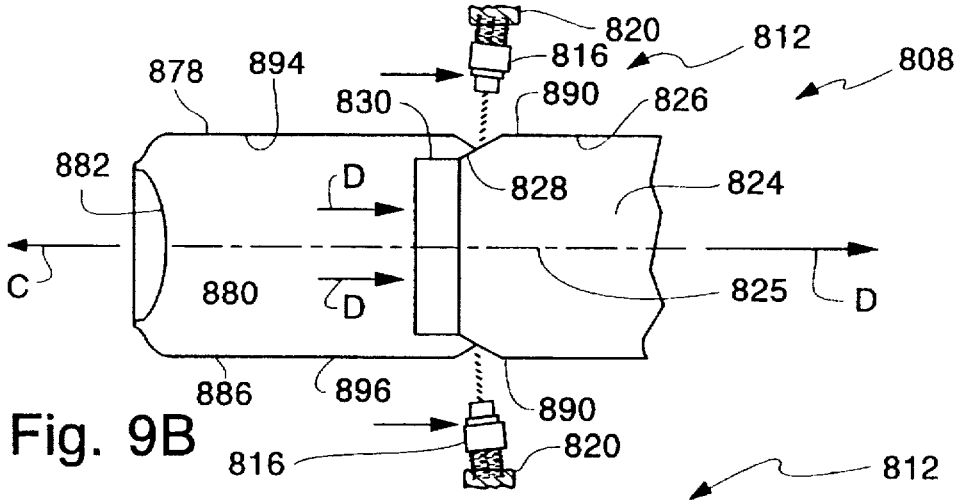
FIG. 9B is a side view of the necking apparatus of FIG. 9A at an intermediate point during necking operations.
Figure 9C:
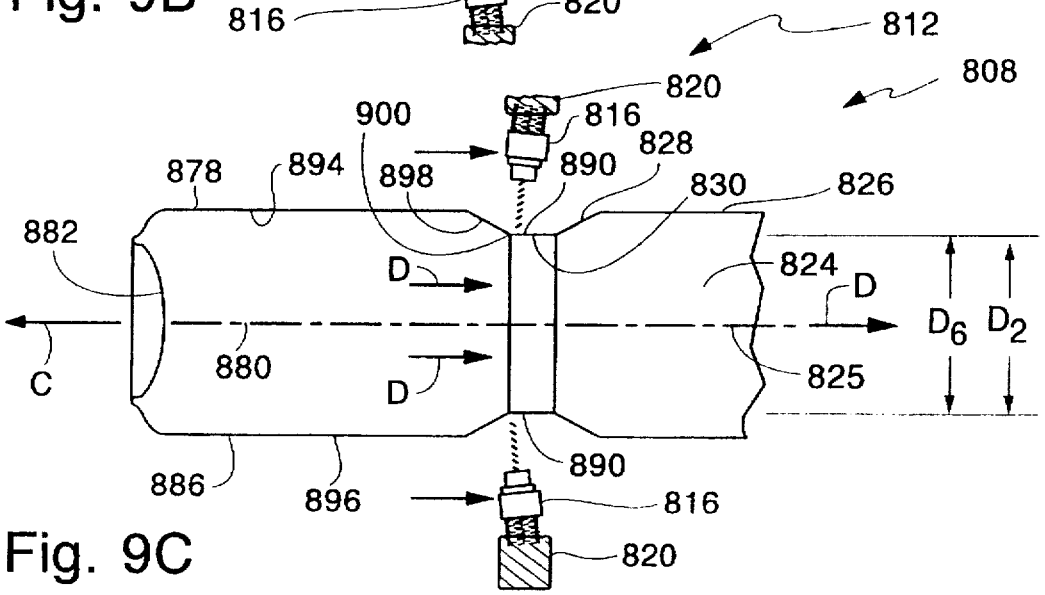
FIG. 9C is a side view of the necking apparatus of FIG. 9A at the end of necking operations.

Another embodiment of a container body reshaping apparatus is illustrated in FIGS. 9A–C in the nature of a necking assembly 808. The above-noted drawn and ironed container body 878 is illustrated in FIG. 9A in its "unnecked" condition, is partially necked in FIG. 9B, and has been completely necked in FIG. 9C. The necking assembly 808 exerts forces on the exterior surface 896 of the container body 878 to reduce the diameter of the open end 890 from the diameter $D_1$ to a diameter $D_2$ (FIGS. 9A and 9C) which is smaller than the diameter $D_1$. This function is again provided by forming a generally frustumly-shaped, annular neck 898 (FIG. 9C) on the upper portion of the sidewall 886 of the container body 878 or from at least a portion of the longitudinal section 888 of the sidewall 886. Necking operations provided by the necking assembly 808 may also form a flange section 900 (FIG. 9C) from the longitudinal section 888. This flange section 900 extends from the upper end of the neck 898 in an orientation which is generally parallel with the container body central axis 880, and thereby in a different orientation than the neck 898. This flange section 900 is again for forming a flange which is used to seam an end piece (not shown) onto the container body 878 after being "filled", or could be the flange itself.

Components of the necking assembly 808 include a container body holder assembly 832 (FIG. 8), discussed above, which engages the container body 878 in the above-noted manner for necking operations, a spray assembly 812 (FIGS. 9A–C) which is disposed exteriorly of the container body 878 and which applies necking forces to the container body 878, and a mandrel 824 which is disposed within an interior 892 of the container body 878 and which provides at least a degree of "control" to relevant portions of the sidewall 886 during necking operations.

The spray assembly 812 includes a nozzle mount ring 820 having a plurality of radially-spaced spray nozzles 816 disposed on the mount ring 820 (e.g., disposed at different angular positions relative to the container body central axis 880). The spray nozzles 816 generally conform with the characteristics of the nozzles 22, 684, and 778 described above and more typically the nozzle 778, such as the fluids used thereby (e.g., water), the types of spray patterns which may be utilized (e.g., stream of fluid, "size" of the fluid as it impacts the container body 878), the nozzle operating pressures (e.g., the velocity at which the fluid stream impacts the container body 878), and the spacing from the container body 878 when first initiating contact therewith. Generally, the spray nozzles 816 each direct a high-velocity fluid stream against a different discrete portion of the upper portion of the sidewall 886 of the container body 878. This exerts a force on the exterior surface 896 of the container body 878 which is generally directed toward the container body central axis 880 and which forms the neck 898 and flange section 900 from the longitudinal section 888 of the sidewall 886 of the container body 878. The high-velocity fluid streams are further directed generally toward the bottom 882 of the container body 878 as in the above-discussed embodiment of a necking apparatus.

The necking assembly 808 further includes the mandrel 824 which is disposed within the interior 892 of the container body 878 and which provides at least a degree of "control" to at least certain relevant portions of the container body 878 during necking operations. The mandrel 824 includes a first mandrel section 826 which is substantially cylindrical and concentric about a mandrel central axis 794 which substantially coincides with the container body central axis 880. The first mandrel section 798 is defined by a diameter $D_5$ which is substantially equal to the diameter $D_1$ of the open end 890 of the container body 878 prior to starting necking operations. As such, the first mandrel section 826 engages or is closely spaced from an annular or circumferential portion of the interior surface 894 of the container body 878 prior to the start of necking operations (FIG. 9A).

The mandrel 824 further includes a second mandrel section 828 which assists in defining the profile for the neck 898 of the container body 878. The second mandrel section 828 is generally frustumly-shaped and concentric about the mandrel central axis 825 in that it extends from the first mandrel section 826 generally inwardly toward the mandrel central axis 825 at a substantially constant angle (e.g., the maximum diameter of the second mandrel section 800 is $D_5$ which is the diameter of the first mandrel section 826). The second mandrel section 828 extends further within the interior 892 of the container 878 than the first mandrel section 826. All portions of the second mandrel section 828 are spaced from the interior surface 894 of the container body 878 at the start of necking operations.

Initial contact between each high-velocity fluid streams and the container body 878 is established at a location which is axially-spaced from the open end 890 of the container body 878 as illustrated in FIG. 9A. This may be close to the junction between the first mandrel section 826 and the second mandrel section 828, but slightly more in the direction of the bottom 882 (i.e., a ray extending perpendicularly outwardly from the container body central axis 880 and to a location on the exterior surface 896 contacted by a high-velocity fluid stream would also pass through the second mandrel section 828 in this case). The spray nozzles 816 are axially advanced relative to the container body 878 along an axis parallel to the container body central axis 880. This advances the point of contact between each high-velocity fluid stream and the container body 878 more toward the open end 890, and thereby allows for a reforming of the longitudinal section 888 of the sidewall 886 of the container body 878. Axially advancing the container body holder 832, with the container body 878 secured thereto, in the direction of the arrow C as illustrated in FIGS. 9A–C will produce this desired relative movement.

The mandrel 824 is also axially advanced relative to the container body 878 along an axis which is substantially parallel with the container body central axis 880. This may be affected by moving the mandrel 824 in the direction of the arrow D in FIGS. 9A–C during necking operations. Different rates of relative axial advancement may be utilized for the "speed" of spray nozzles 816 and the mandrel 824 to allow for formation of the neck 898. In the illustrated embodiment note the change in relative axial positions between the spray nozzles 816 and the mandrel 824 between FIGS. 9A and 9B and between FIGS. 9B and 9C which illustrates that mandrel 824 is moving axially relative to the container body 878 at a greater rate than the relative axial movement between the spray nozzles 816 and the container body 878. Through these relative axial movements, the neck 898 is formed by forcing portions of the longitudinal section 888 against the second mandrel section 828.

The mandrel 824 further includes a third mandrel section 830 which assists in defining the profile for the flange section 900 which extends from the neck 898 of the container body 878 in a different orientation than the neck 898. The third mandrel section 830 extends from the end of the second mandrel section 800 further into the interior 892 of the container body 878, and in the illustrated embodiment is substantially cylindrical and concentric with the mandrel central axis 825. This configuration for the third mandrel section 830 provides a profile for the flange section 900 which is substantially cylindrical and concentric about the container body central axis 880.

The third mandrel section 830 is defined by a diameter $D_6$ which is less than the diameter $D_5$ of the first mandrel section 826 and the diameter $D_1$ of the open end 890 of the container body 878 prior to being necked. The diameter $D_6$ is substantially equal to the diameter $D_2$ of the open end 890 of the container body 878 after being necked by the necking assembly 808. All portions of the third mandrel section 830 are spaced from the interior surface 894 of the container body 878 at the start of necking operations as illustrated in FIG. 9A. After the neck 898 is formed in the above-noted manner and while the mandrel 824 is being retracted, portions of the sidewall 886 will be forced into conforming engagement with the third mandrel section 830 to define the flange section 900 on the container body 878.

In summarizing a necking procedure with the necking assembly 808, a container body 878 having a generally cylindrical sidewall 886 with an open end 890 having a diameter $D_1$ is mounted in the container body holder 832 (FIG. 8). Application of a vacuum through the vacuum passage 844 pulls the container body 878 toward and into firm engagement the container body holder assembly 832. The initial relative axial or longitudinal position between the container body 878 and the spray nozzles 816 is such that when fluid is directed from the spray nozzles 816 toward the container body 878, may be such that the fluid will impact the exterior surface 896 of the container body 878 at a location which is axially spaced from the open end 890 of the container body 878. Moreover, the relative axial position between the spray nozzles 816 and the mandrel 824 may be such that the vector corresponding with the particular high-velocity stream from each spray nozzle 816 will be directed toward a portion of the second mandrel section 828.

The mandrel 824 is disposed within the interior 892 of the container body 878 typically before directing fluid through the spray nozzles 816. Relative longitudinal or axial movement along an axis parallel with the container body central axis 880 may be used to advance the mandrel 790 through the open end 890 of the container body 878 and into a position where the second mandrel section 828 and third mandrel section 830 are both spaced from the interior surface 894 of the container body 878 and where the first mandrel section 826 engages an upper annular portion of the sidewall 886 adjacent the open end 890. The portion of the first mandrel section 826 disposed furthest within the interior 892 of the container body 878 will typically will be disposed close to but slightly spaced from the location where the high-velocity fluid stream from each of the spray nozzles 816 will initially impact the exterior surface 896 of the container body 878.

The container body holder assembly 832 is rotated to rotate the container body 878 about the container body central axis 880. This provides relative rotational movement between the container body 878 and each of the spray nozzles 816 which is required to reform an annular portion of the sidewall 886 of the container body 878 with a plurality of radially spaced nozzles 816 and discrete fluid streams. The mandrel 824 may be free spinning about the mandrel central axis 825 at this time. Fluid directed out of each of the spray nozzles 816 at a high velocity impacts different, radially spaced, discrete portions of the exterior surface 896 of the sidewall 886 of the container body 878. Impacting of the high velocity fluid streams on the exterior surface 896 of the container body 878 at a location which is spaced from the mandrel 824 forces the contacted portion of the container body 878 radially inwardly toward the container body central axis 880 and toward the mandrel 824.

Through the relative rotational movement between the container body 878 and the spray nozzle 778, the impacting of the high-velocity fluid streams on the sidewall 886 of the container body reforms an annular portion thereof. Specifically, this annular portion of the container body 878 is forced inwardly toward the container body central axis 880 until it engages a corresponding portion of the mandrel 824. Initially this will be the second mandrel section 826. Continued relative rotational movement between the spray nozzles 816 and the container body 878, continued axial movement between the container body 878 relative to each of the spray nozzles 816, such as moving the container body holder assembly 832 in the direction of the arrow C, and continued relative axial advancement between the container body 878 and the mandrel 824 such as by moving the mandrel 824 in the direction of the arrow D, and further, at a greater relative rate than the relative axial rate between the container body 878 and the spray nozzles 816, reforms a portion of the longitudinal section 888 of the sidewall 886 into the shape of the neck 898 (note the change in the axial position of the spray nozzles 816 and the mandrel 824 between FIG. 9A (corresponding with the start of necking operations) and FIG. 9B (corresponding with the completion of the formation of the neck 898)).

The above-noted relative movements between the container body 878 and each of spray nozzles 816 and the mandrel 824 may continue after the neck 824 is defined. For instance, further action of the high-velocity fluid streams from the spray nozzles 816 may cause any remaining the portion of the sidewall 886 between the upper end of the neck 898 and the open end 890 to substantially conform to the shape of the third mandrel section 830 as illustrated in FIG. 9C. Once the high-velocity fluid streams no longer contact the container body 878 due to the above-noted relative advancements, the necking process is complete and may be repeated for additional container bodies.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. A method for reshaping a container body, comprising the steps of:

exposing a surface of said container body to a first fluid under a substantially constant pressure; and directing a high velocity stream of a second fluid, different from said first fluid, directly against a selected and discrete portion of said surface of said container body to reform at least a portion of said container body, said directing step being performed during said exposing step.

2. A method, as claimed in claim 1, wherein:

said exposing step comprises controlling said surface of said container body throughout a substantial portion of said directing step.

3. A method, as claimed in claim 1, wherein:

said exposing step comprises exposing said surface to said first fluid and providing a pressure which increases in a controlled manner.

4. A method, as claimed in claim 1, wherein:

said directing a second fluid step comprises directing said second fluid through said first fluid and against said at least a portion of said surface of said container body.

5. A method, as claimed in claim 1, wherein:

said exposing step comprises exposing said surface to said first fluid at a substantially constant pressure which is within a range of about 20 psi to about 100 psi and said directing a second fluid step comprises directing a stream of said second fluid directly against a selected and discrete portion of said interior surface of said container body at a nozzle pressure which is at least about 1,000 psi.

6. A method for reshaping a container body wherein said container body comprises a sidewall with interior and exterior surfaces, the method comprising the steps of:

exposing a surface of said container body to a first fluid under a substantially constant pressure; and directing a second fluid, different from said first fluid, against at least a portion of said surface of said container body to reform at least a portion of said container body, said directing step being performed during said exposing step, wherein said exposing step comprises introducing said first fluid into an interior of said container body and maintaining a substantially constant pressure in said interior of said container body throughout a substantial portion of said directing step.

7. A method for reshaping a container body, comprising the steps of:

exposing a surface of said container body to a first fluid under a substantially constant pressure; and directing a second fluid, different from said first fluid, against at least a portion of said surface of said container body to reform at least a portion of said container body, said directing step being performed during said exposing step wherein said exposing step comprises using a first gas for said first fluid.

8. A method, as claimed in claim 7, wherein:

said exposing step comprises using air for said first fluid.

9. A method, as claimed in claim 7, wherein:

said exposing step comprises exposing said surface to said first fluid at a substantially constant pressure which creates a tensile hoop stress on said surface of said container body which is within a range of about 10% to about 50% of a yield strength of said container body.

10. A method, as claimed in claim 7, wherein:

said exposing step comprises exposing said surface to said first fluid at a substantially constant pressure which is within a range of about 20 psi to about 100 psi.

11. A method, as claimed in claim 7, wherein:

said exposing step comprises exposing said surface to said first fluid at a substantially constant pressure which is within a range of about 30 psi to about 60 psi.

12. A method for reshaping a container body, comprising the steps of:

exposing a surface of said container body to a first fluid under a substantially constant pressure; and directing a second fluid, different from said first fluid, against at least a portion of said surface of said container body to reform at least a portion of said container body, said directing step being performed during said exposing step wherein said directing a second fluid step comprises directing a stream of liquid against said surface of said container body during said exposing step.

13. A method, as claimed in claim 12, wherein:

said exposing step comprises using a gas for said first fluid.

14. A method for reshaping a container body, comprising the steps of:

exposing a surface of said container body to a first fluid under a substantially constant pressure; and directing a second fluid, different from said first fluid, against at least a portion of said surface of said container body to reform at least a portion of said container body, said directing step being performed during said exposing step wherein said container body comprises a sidewall with interior and exterior surfaces and wherein said exposing and directing steps are performed on said interior surface, said method further comprising the step of:

draining said second fluid from an interior of said container body throughout a substantial portion of said exposing and directing steps.

15. A method for reshaping a container body, wherein said container body comprises a sidewall with interior and exterior surfaces, an end wall interconnected with said sidewall, and an open end opposite said end wall, comprising the steps of:

exposing a surface of said container body to a first fluid under a substantially constant pressure; and directing a second fluid, different from said first fluid, against at least a portion of said surface of said container body to reform at least a portion of said container body, said directing step being performed during said exposing step wherein said exposing and directing steps are each performed on said interior surface, said method further comprising the step of sealing said open end of said container body throughout a substantial portion of said exposing and directing steps.

16. A method for reshaping a container body, comprising the steps of:

exposing a surface of said container body to a first fluid under a substantially constant pressure;

directing a second fluid, different from said first fluid, against at least a portion of said surface of said container body to reform at least a portion of said container body, said directing step being performed during said exposing step; and axially loading said container body during said exposing and directing steps.

17. A method, as claimed in claim 16, wherein:

said axially loading step comprises applying an axially-compressive force to said container body which is within a range of about 20 pounds force to about 40 pounds force.

18. A metal container body reforming apparatus, comprising:

a mold comprising a mold surface defining a mold cavity, wherein a metal container body is positionable within said mold cavity;

means for pressurizing an interior of said container body to a predetermined level when said container body is in said mold cavity;

means for directing a high velocity fluid stream against a selected portion of an interior surface of said container body when said container body is in said mold cavity and during operation of said means for pressurizing, wherein said means for directing forces said selected portion of said container body toward said mold surface.

19. An apparatus, as claimed in claim 18, wherein:

said container body comprises a sidewall, a closed first end, and an open second end opposite said first end, wherein said means for pressurizing comprises means for sealing said open second end of said container body.

20. An apparatus, as claimed in claim 19, wherein:

said means for sealing comprises a sealing vessel, said sealing vessel comprising means for sealingly receiving said open second end of said container body and a first cavity fluidly connected and aligned with said means for sealingly receiving, wherein said means for pressurizing comprises a first conduit fluidly connected with said first cavity and wherein said means for directing comprises a second conduit which extends through said first cavity and into an interior of said container body.

21. An apparatus, as claimed in claim 18, wherein:

said means for directing comprises a conduit which extends through an open end of said container body and into an interior of said container body and at least one nozzle associated with said conduit which is disposable in said interior of said container body.

22. An apparatus, as claimed in claim 18, wherein:

said means for directing comprises at least one spray nozzle, each said spray nozzle being spaced from said selected portion of said container body a first distance which ranges from about ⅛ inch to about ¾ inch.

23. An apparatus, as claimed in claim 18, wherein:

said means for directing comprises a plurality of longitudinally-spaced spray members disposable within an interior of said container body.

24. An apparatus, as claimed in claim 18, further comprising:

means for rotating at least one of said mold and said means for directing relative to the other of said mold and said means for directing.

25. An apparatus, as claimed in claim 18, further comprising:

means for longitudinally moving at least one of said mold and said means for directing relative to the other of said mold and said means for directing.

26. An apparatus, as claimed in claim 25, further comprising:

means for rotating said means for directing relative to said mold, wherein said means for directing is rotated and a center of rotation for said means for directing is a central, longitudinal axis of the container body, and wherein said means for directing is longitudinally movable along said central, longitudinal axis of the container body.

* * * * *